US007473400B2

(12) United States Patent
Watanabe et al.

(10) Patent No.: US 7,473,400 B2
(45) Date of Patent: Jan. 6, 2009

(54) MICROFLUID HANDLING DEVICE

(75) Inventors: Yasuhiro Watanabe, Saitama (JP); Masanobu Natsuhara, Saitama (JP)

(73) Assignee: Enplas Corporation (JP)

( * ) Notice: Subject to any disclaimer, the term of this patent is extended or adjusted under 35 U.S.C. 154(b) by 777 days.

(21) Appl. No.: 10/802,353

(22) Filed: Mar. 16, 2004

(65) Prior Publication Data

US 2004/0184964 A1 Sep. 23, 2004

(30) Foreign Application Priority Data

Mar. 20, 2003 (JP) ..... P2003-077034

(51) Int. Cl.
*B01L 3/00* (2006.01)

(52) U.S. Cl. ..... 422/100

(58) Field of Classification Search ..... 422/100, 422/61

See application file for complete search history.

(56) References Cited

U.S. PATENT DOCUMENTS 3,799,742 A * 3/1974 Coleman ..... 422/61

FOREIGN PATENT DOCUMENTS

JP 2002-36196 2/2002
JP 2002-66399 3/2002
JP 2002-66999 3/2002
JP 2002-282682 10/2002

* cited by examiner

*Primary Examiner*—Walter D Griffin
*Assistant Examiner*—Christine T Mui
(74) *Attorney, Agent, or Firm*—Bachman & LaPointe, P.C.

(57) ABSTRACT

There is provided an inexpensive microfluid handling device which is capable of simply controlling the flow of plural kinds of very small amounts of liquids (microsamples) independently of a driving source and which is suitable for a POC inspection. In the microfluid handling device 1, there is formed a fine groove 10 forming a microchannel for allowing a liquid sample to move due to capillarity. At one end of the fine groove 10 of the microfluid handling device 1, a storage portion 6 (7) is formed for injecting a sample S1 (S2) into the fine groove 10. At the other end of the fine groove 10, there is formed a final storage portion 8 capable of being used for taking out the sample S1 (S2) flowing through the fine groove 10 due to capillarity. The storage portion 6 (7) is open to the atmosphere. The bottom of the final storage portion 8 is sealed with a sealing protrusion 11 capable of being broken off, and is open by breaking the sealing protrusion 11 off.

13 Claims, 16 Drawing Sheets

MICROFLUID HANDLING DEVICE

BACKGROUND OF THE INVENTION

1. Field of the Invention

The present invention generally relates to a microfluid handling device having a flow passage capable of allowing a fluid to run therein due to capillarity. More specifically, the invention relates to a microfluid handling device which is used as a micro chip or the like in a technical field called integrated chemistry and which is used for moving and/or mixing plural kinds of very small amounts of liquid samples or used as a POC (point of care) inspecting device.

2. Description of the Prior Art

In recent years, there is known a technique called integrated chemistry for forming a fine groove having a width and depth of about one to thousand micrometers in a micro chip of a glass or plastic, to use the fine groove as a liquid passage, reaction vessel or separation/purification detecting vessel, to integrate a complicated chemical system into the micro chip. According to such integrated chemistry, a micro chip (Lab-on-a-chip) having a fine groove used in various tests is called μ-TAS (Total Analytical System) if the use of the micro chip is limited to analytical chemistry, and the micro chip is called micro reactor if the use of the micro chip is limited to a reaction. When various tests, such as analyses, are carried out, integrated chemistry has advantages that the time to transport diffuse molecules is short due to small space and that the heat capacity of a liquid phase is very small. Therefore, integrated chemistry is noticed in the technical field wherein a micro space is intended to be utilized for carrying out analysis and chemical synthesis. Furthermore, the term "test" means to carry out any one or combination of operations and means, such as analysis, measurement, synthesis, decomposition, mixing, molecular transportation, solvent extraction, solid phase extraction, phase separation, phase combination, molecule acquisition, culture, heating and cooling.

In such integrated chemistry, it is required to open and close a fine liquid passage, which has a width and height of about one to thousand micrometers and which is formed in a glass or plastic chip, to allow a sample to move in the fine liquid passage. Thus, there have been proposed various valve structures for opening and closing a fine liquid passage.

For example, in a technique disclosed in Japanese Patent Laid-Open No. 2002-36196, a movable film of a photoresponsive material arranged in a branch connection or the like of a liquid passage is irradiated with laser beams to be deformed so as to control the flow of a liquid in the liquid passage. In a technique disclosed in Japanese Patent Laid-Open No. 2002-66399, a gel chamber formed in the middle of a capillary tube-like passage is filled with a temperature sensitive gel which is heated to be expanded to protrude into the capillary tube-like passage to change the cross-sectional area of the passage. In a technique disclosed in Japanese Patent Laid-Open No. 2002-282682, a solenoid valve arranged in the middle of a fine liquid passage is open and closed to control the flow of a very small amount of sample.

However, in the above described conventional techniques disclosed in Japanese Patent Laid-Open Nos. 2002-36196, 2002-66399 and 2002-282682, a valve mechanism is provided in the middle of a liquid passage having a vary small cross-sectional area, and it is difficult to work such a valve mechanism, so that there is a problem in that a plate (e.g., a micro chip) having such a valve mechanism is very expensive.

SUMMARY OF THE INVENTION

It is therefore an object of the present invention to eliminate the aforementioned problems and to provide an inexpensive microfluid handling device which is capable of simply controlling the flow of plural kinds of very small amounts of liquids (microsamples) independently of a driving source and which is suitable for a POC inspection.

In order to accomplish the aforementioned and other objects, according to one aspect of the present invention, a fluid handling device comprises: a device body; a flow passage which is formed in the device body and which has a shape for allowing a fluid to move therein due to capillarity, one end of the flow passage being open to an outside environment; and a sealing portion for sealing the other end of the fluid passage to isolate the other end of the flow passage from the outside environment, at least a part of the sealing portion being capable of being disengaged from the other end of the flow passage so as to allow the other end of the flow passage to be open to the outside environment.

This fluid handling device may further comprise a storage portion capable of storing therein the fluid, the storage portion being arranged at the one end of the flow passage so that the one end of the flow passage is open to the outside environment via the storage portion. Alternatively, the fluid handling device may further comprise a second sealing portion for sealing the one end of the flow passage to isolate the one end of the flow passage from the outside environment, at least a part of the second sealing portion being capable of being disengaged from the one end of the flow passage so as to allow the one end of the flow passage to be open to the outside environment. Alternatively, the fluid handling device may further comprise: a storage portion capable of storing therein the fluid, the storage portion being arranged at the one end of the flow passage; and a third sealing portion for sealing the storage portion to isolate the storage portion from the outside environment, at least a part of the third sealing portion being capable of being disengaged from the storage portion so as to allow the one end of the flow passage to be open to the outside environment via the storage portion.

According to another aspect of the present invention, a fluid handling device comprises: a device body; at least three flow passages which are formed in the device body and which have a shape for allowing a fluid to move therein due to capillarity, one end of each of the at least three flow passages being connected to be communicated with each other, and the other end of each of the at least three flow passages being open; and a sealing portion for sealing the other end of at least one of the at least three flow passages to isolate the other end of the at least one of the at least three flow passages from an outside environment, at least a part of the sealing portion being capable of being disengaged from the other end of the at least one of the at least three flow passages so as to allow the other end of the at least one of the at least three flow passages to be open to the outside environment.

This fluid handling device may further comprise a storage portion capable of storing therein the fluid, the storage portion being arranged at the other end of at least one of the at least three flow passages.

According to another aspect of the present invention, a fluid handling device comprises: a device body; a main flow passage which is formed in the device body and which has a shape for allowing a fluid to move therein due to capillarity, one end of the main flow passage being open to an outside environment; at least one sub-flow passage which is formed in the device body and which has a shape for allowing a fluid to move therein due to capillarity, one end of the at least one sub-flow passage being communicated with the main flow passage between the one and other ends of the main flow passage, and the other end of the at least one sub-flow passage being open to the outside environment; and a sealing portion for sealing the other end of the main flow passage to isolate the other end of the main flow passage from the outside environment, at least a part of the sealing portion being capable of being disengaged from the other end of the main flow passage so as to allow the other end of the main flow passage to be open to the outside environment.

According to another aspect of the present invention, a fluid handling device comprises: a device body; a main flow passage which is formed in the device body and which has a shape for allowing a fluid to move therein due to capillarity, one end of the main flow passage being open to an outside environment; a first sub-flow passage which is formed in the device body and which has a shape for allowing a fluid to move therein due to capillarity, one end of the first sub-flow passage being communicated with the main flow passage between the one and other ends of the main flow passage, and the other end of the first sub-flow passage being open to the outside environment; a second sub-flow passage which is formed in the device body and which has a shape for allowing a fluid to move therein due to capillarity, one end of the second sub-flow passage being communicated with the first sub-flow passage between the one and other ends of the first sub-flow passage, and the other end of the second sub-flow passage being open to the outside environment; and a sealing portion for sealing the other end of the main flow passage to isolate the other end of the main flow passage from the outside environment, at least a part of the sealing portion being capable of being disengaged from the other end of the main flow passage so as to allow the other end of the main flow passage to be open to the outside environment.

According to a further aspect of the present invention, a fluid handling device comprises: a device body; a flow passage which is formed in the device body and which has a shape for allowing a fluid to move therein due to capillarity, the flow passage having a plurality of ends which are open to an outside environment; and a sealing portion for sealing at least one of the plurality of ends of the flow passage to isolate the at least one of the plurality of ends from the outside environment, at least a part of the sealing portion being capable of being disengaged from the at least one of the plurality of ends so as to allow the at least one of the plurality of ends to be open to the outside environment.

This fluid handling device may further comprise at least one storage portion capable of storing therein the fluid, the at least one storage portion being communicated with at least one of the plurality of ends.

According to a still further aspect of the present invention, a fluid handling device comprises: a device body; a flow passage formed in the device body so as to have a shape for allowing a fluid to move therein due to capillarity, the flow passage having first, second and third open ends; a first opening for injecting a first fluid into the flow passage, the first opening being formed in the device body and communicated with the first open end of the flow passage; a second opening for injecting a second fluid into the flow passage, the second opening being formed in the device body and communicated with the second open end of the flow passage; a third opening which is formed in the device body and which is communicated with the third open end of the flow passage; and a sealing portion for sealing the third opening, at least a part of the sealing portion being capable of being disengaged from the third opening, wherein the first and second fluids injected from the first and second openings are capable of moving in the flow passage due to capillarity, to be mixed or reacted with each other to form a mixed or reacted fluid which is fed to the third open end of the flow passage.

This fluid handling device may further comprise: a second sealing portion for sealing the first opening, at least a part of the second sealing portion being capable of being disengaged from the first opening; and a third sealing portion for sealing the second opening, at least a part of the third sealing portion being capable of being disengaged from the second opening.

BRIEF DESCRIPTION OF THE DRAWINGS

The present invention will be understood more fully from the detailed description given herebelow and from the accompanying drawings of the preferred embodiments of the invention. However, the drawings are not intended to imply limitation of the invention to a specific embodiment, but are for explanation and understanding only.

In the drawings.

DESCRIPTION OF THE PREFERRED EMBODIMENTS

Referring now to the accompanying drawings, the preferred embodiments of a microfluid handling device according to the present invention will be described below in detail. In the following preferred embodiments, a microfluid handling device, which is used as a micro chip or the like in a technical field called integrated chemistry and which is used for mixing plural kinds of very small amounts of samples or used as a POC inspecting device, will be described.

First Preferred Embodiment

Figure 1:
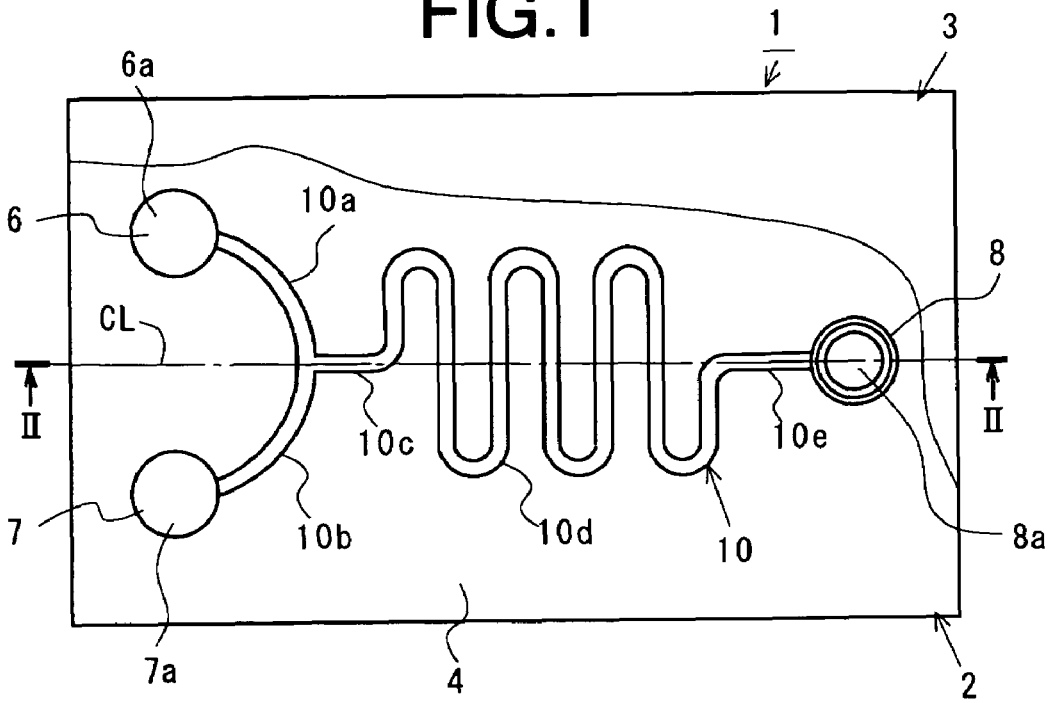
FIG. 1 is a bottom view of a part of the first preferred embodiment of a microfluid handling device according to the present invention, which is viewed along arrow Y1 of FIG. 2.
Figure 2:
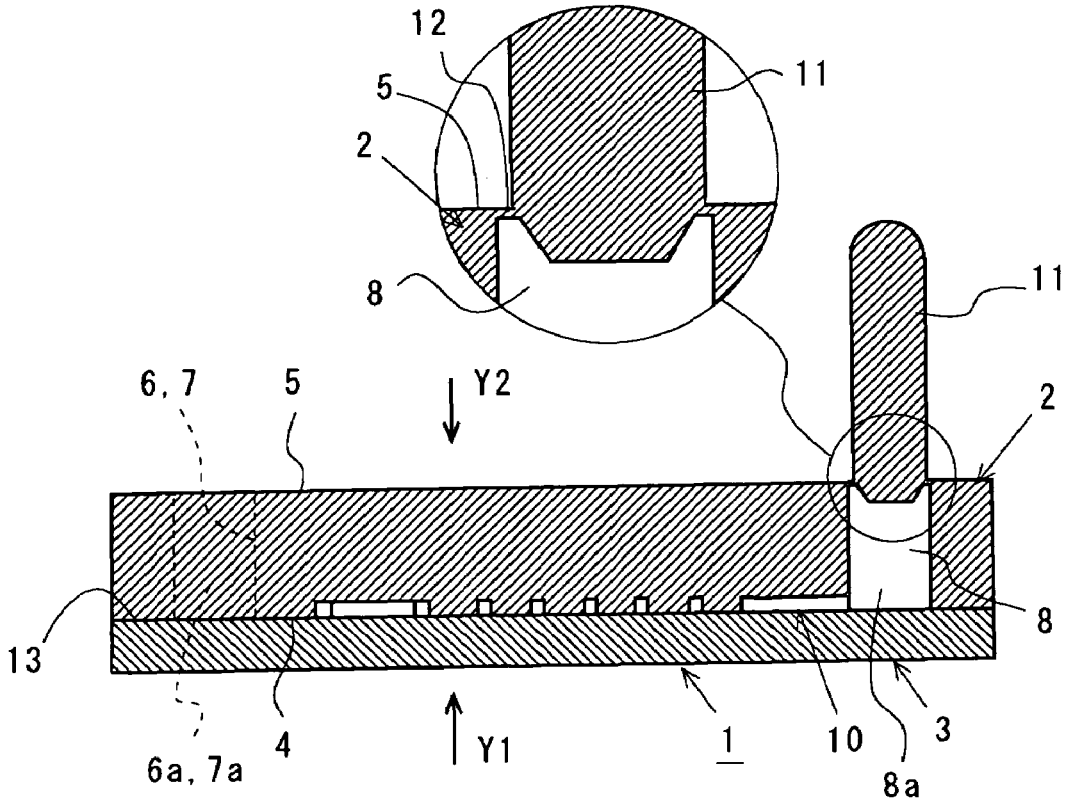
FIG. 2 is a sectional view of the first preferred embodiment of a microfluid handling device according to the present invention, which is taken along line II-II of FIG. 1.
Figure 3:
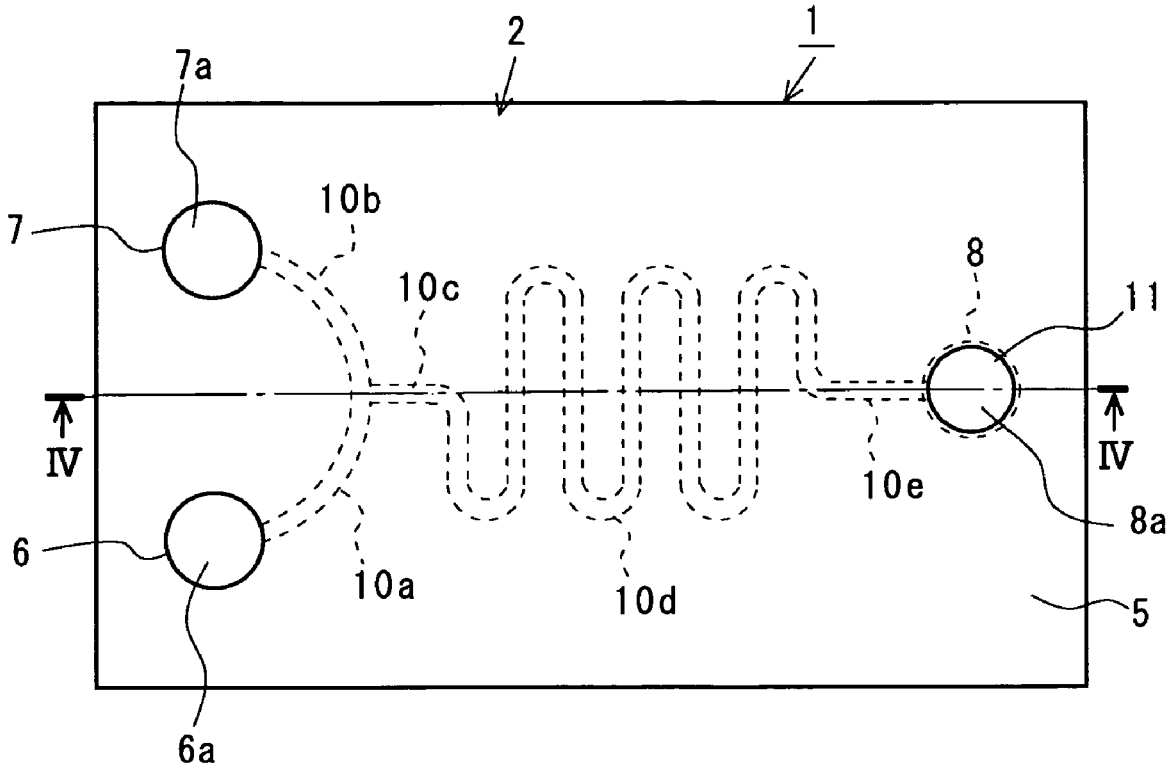
FIG. 3 is a plan view of the first preferred embodiment of a microfluid handling device according to the present invention, which is viewed along arrow Y2 of FIG. 2.
Figure 4A:
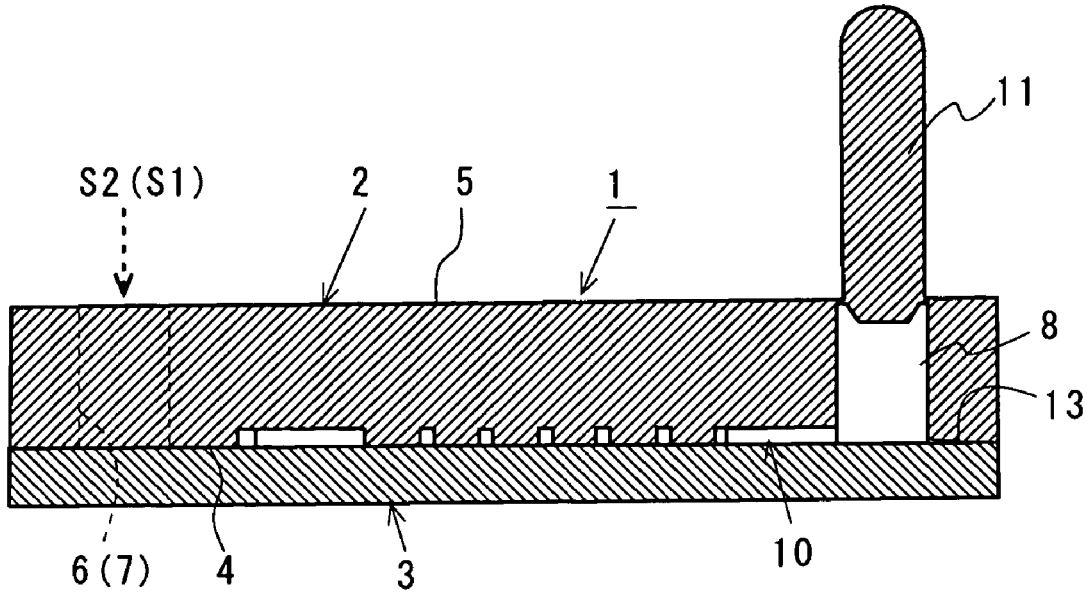
FIGS. 4A and 4B are sectional views taken along line IV-IV of FIG. 3, which show a state that the first preferred embodiment of a microfluid handling device according to the present invention is used.
Figure 4B:
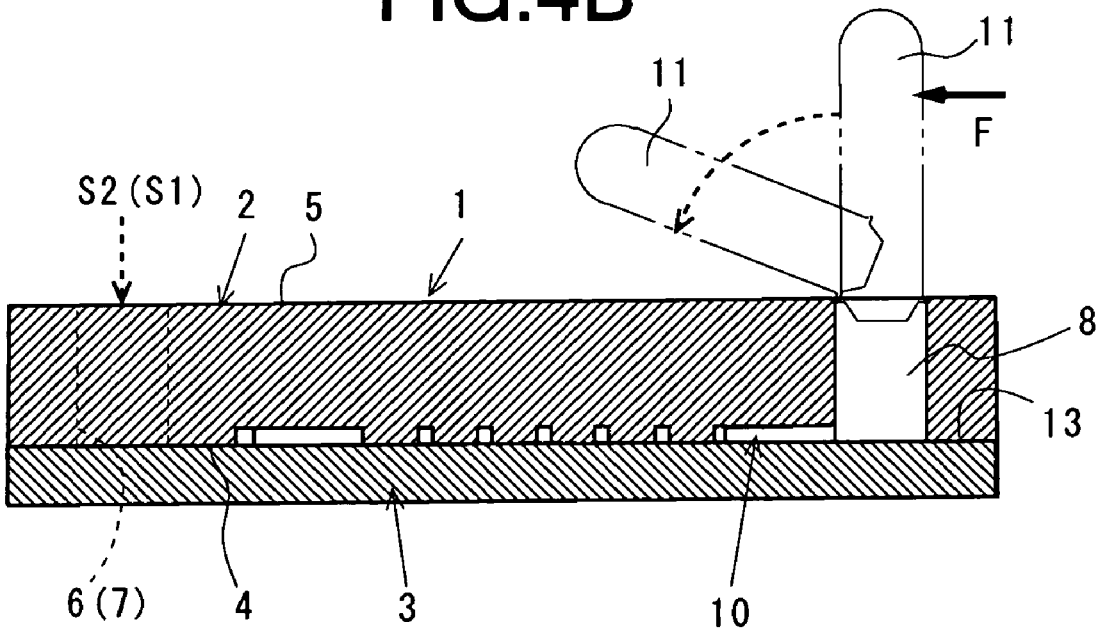

FIGS. 1 through 4B show the first preferred embodiment of a microfluid handling device 1 according to the present invention. FIG. 1 is a bottom view (which is viewed along arrow Y1 of FIG. 2) of the microfluid handling device 1, wherein a second plate member 3, which will be described later, is partially removed. FIG. 2 is a sectional view of the microfluid handling device 1 taken along line II-II of FIG. 1, and FIG. 3 is a plan view of the microfluid handling device 1 which is viewed along arrow Y2 of FIG. 2. FIGS. 4A through 4B are sectional views of the microfluid handling device 1 taken along line IV-IV of FIG. 3, which shows a state that the microfluid handling device 1 is used.

As shown in these figures, the microfluid handling device 1 comprises a first plate member 2 and a second plate member 3 which is piled and fixed on a first smooth surface 4 of the first plate member 2. The first plate member 2 and second plate member 3 forming the microfluid handling device 1 are formed of a resin, such as polycarbonate (PC) or polymethyl methacrylate (PMMA). The material of the microfluid handling device 1 should not be limited thereto. The microfluid handling device 1 may be formed of a synthetic resin other than PC and PMMA, or an inorganic material, such as a glass or metal.

The first plate member 2 has a pair of through holes 6*a* and 7*a* which pass through the first plate member 2 from a second surface 5 to the first surface 4 and which are symmetrical with respect to the center line CL of the first plate member 2. The first plate member 2 also has a recessed portion 8*a* which is arranged on the center line CL so as to be apart from the through holes 6*a* and 7*a* and which is recessed from the first surface 4 toward the second surface 5. The first surface 4 of the first plate member 2 has a fine groove (a recessed portion forming a flow passage for causing capillarity) 10 which is communicated with the through holes 6*a* and 7*a* and recessed portion 8*a*.

The fine groove 10 of the first surface 4 of the first plate member 2 comprises: a pair of curved portions 10*a* and 10*b*, each of which extends from a corresponding one of the pair of through holes 6*a* and 7*a* to the center line CL; a first linear portion 10*c* which is communicated with the curved portions 10*a* and 10*b* on the center line CL and which extends along the center line CL; an intermediate portion 10*d* which extends from the first linear portion 10*c* meandering across the center line CL; and a second linear portion 10*e* which is communicated with the end portion of the intermediate portion 10*d* and the recessed portion 8 and which extends along the center line CL. The pair of curved portions 10*a* and 10*b* forming the fine groove 10 are symmetrical with respect to the center line CL so that the length of the curved portion 10*a* from the through hole 6*a* to the first linear portion 10*c* is equal to the length of the curved portion 10*b* from the through hole 7*a* to the first linear portion 10*c*.

Such a fine groove 10 has a substantially rectangular cross section. The intermediate portion 10*d* of the fine groove 10 meanders so that a flow passage for a sample has a sufficient length in a small space. The sectional area and length of the fine groove 10 are determined so as to be optimum in accordance with the kind or the like of the sample.

The first plate member 2 has a sealing protrusion 11, which is formed so as to be integrated therewith, on the bottom of the recessed portion 8*a* on the side of the second surface 5. The sealing protrusion 11 serves as a sealing portion capable of being broken off by operator's fingers. By breaking the sealing protrusion 11 off, the recessed portion 8*a* is open on the side of the second surface 5 (see FIGS. 4A and 4B). As shown by an enlarged sectional view of a part of the sealing protrusion 11 in FIG. 2, the sealing protrusion 11 is formed so as to close the end portion of the recessed portion 8*a* on the side of the second surface 5, and is connected and integrated with the first plate member 2 via a flange-shaped thin connecting portion 12, so that the recessed portion 8*a* is isolated from the outside environment (the atmosphere in this preferred embodiment). Then, as shown in FIG. 4B, if force is applied to the sealing protrusion 11 in the direction of arrow F by, e.g., operator's fingers, to push the sealing protrusion 11 down, the thin connecting portion 12 is broken off, so that the sealing protrusion 11 is removed from the first plate member 2 to allow the recessed portion 8*a* to be open on the side of the second surface 5 (see FIG. 4B).

The first surface 13 of the second plate member 3 is a smooth surface so as to contact the first surface 4 of the first plate member 2 when it is piled on the first smooth surface 4 of the first plate member 2. If the second plate member 3 is piled and fixed on the first plate member 2, the opening portions of the fine groove 10, and the opening portions of the through holes 6*a* and 7*a* and recessed portion 8*a* on the side of the first surface 4 can be airtightly or fluid-tightly closed. To be "fixed" is herein achieved by well-known fixing means including detachable fixing means, such as a screw and a clip, in addition to means, such as bonding, welding and adhesion.

Thus, the opening portions of the fine groove 10 of the first plate member 2, and the opening portions of the through holes 6*a* and 7*a* and recessed portion 8*a* of the first plate member 2 on the side of the first surface 4 are airtightly or fluid-tightly closed by the first surface 13 of the second plate member 3 to form the microfluid handling device 1. Thus, a fine flow passage (microchannel) is formed by four surfaces of the bottom and both side surfaces of the fine groove 10 and the first surface 13 of the second plate member 3 covering the opening portion of the fine groove 10. Simultaneously, the through holes 6*a* and 7*a* are open on the side of the second surface 5 to form first and second storage portions (reservoirs) 6 and 7 which are communicated with the atmosphere, and the recessed portion 8*a* having the sealing protrusion 11 on the end portion on the side of the second surface 5 forms a final storage portion 8.

If the first plate member 2 and the second plate member 3 are fixed to each other by an adhesive, while the plate members 2 and 3 are piled on each other, the adhesive is allowed to flow into a gap between the plate members 2 and 3 by utilizing capillarity. Thus, the adhesive can be supplied to the opening portion of the fine groove 10 without preventing the adhesive to enter the fine groove 10, so that it is possible to form a flow passage having a good geometry.

Figure 5A:
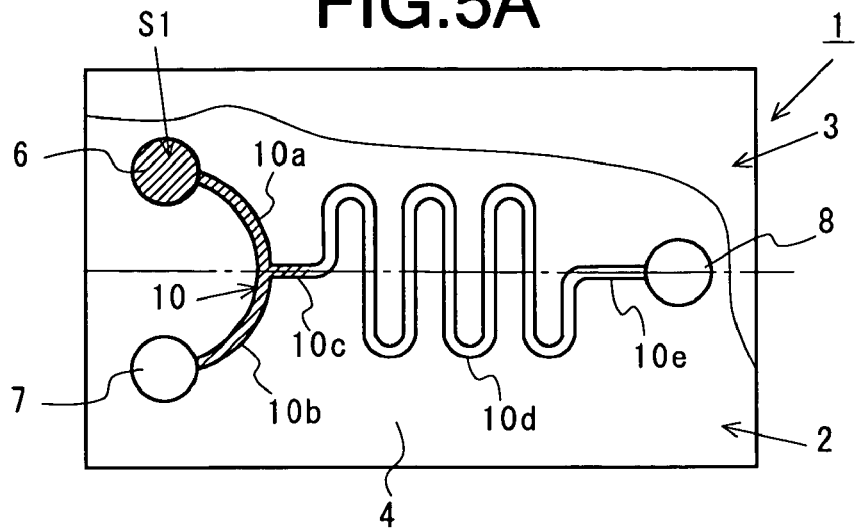
FIGS. 5A through 5C are illustrations showing a state that samples are mixed in the first preferred embodiment of a microfluid handling device according to the present invention.
Figure 5B:
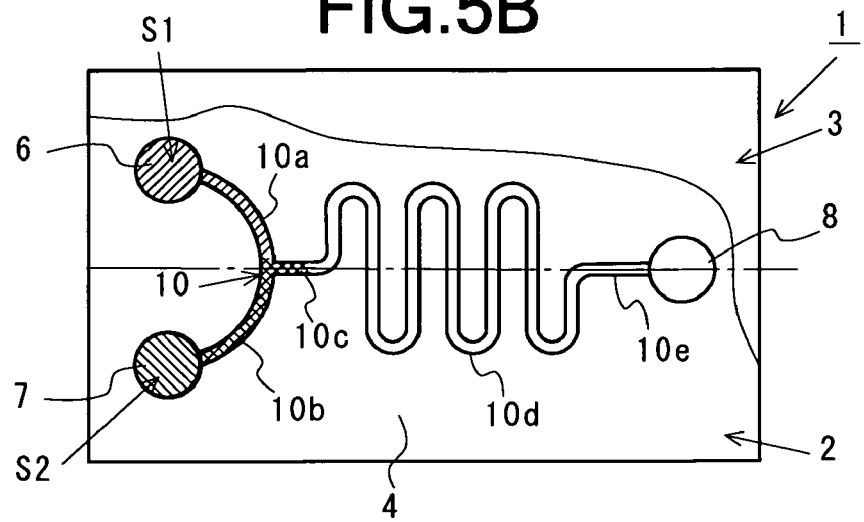

If a predetermined amount of first liquid sample (e.g., a solution including a specimen) S1 is injected into one (e.g., the first storage portion 6) of the pair of storage portions 6 and 7 in the state shown in FIG. 4A, the first sample S1 runs through the curved portions 10*a* and 10*b* of the fine groove 10 toward the second storage portion 7. The first sample S1 injected into the first storage portion 6 runs due to capillarity caused in the fine groove 10 and due to pressure gradient in the fine groove 10. Thus, as shown in FIG. 5A, the first sample S1 flows into the first linear portion 10*c* of the fine groove 10, which is communicated with the curved portions 10*a* and 10*b*, while running through the curved portions 10*a* and 10*b* of the fine groove 10 toward the second storage portion 7, but the first sample S1 does not flow into the second storage portion 7. Thereafter, if a second sample S2 (e.g., a solution including a material capable of specifically reacting with the specimen) is injected into the second storage portion 7, the second sample S2 flows into the curved portions 10*b* and 10*a* to contact the first sample S1 as shown in FIG. 5B. However, at this time, the first sample S1 in the first storage portion 6 is not completely mixed with the second sample S2 in the second storage portion 7.

Figure 5C:
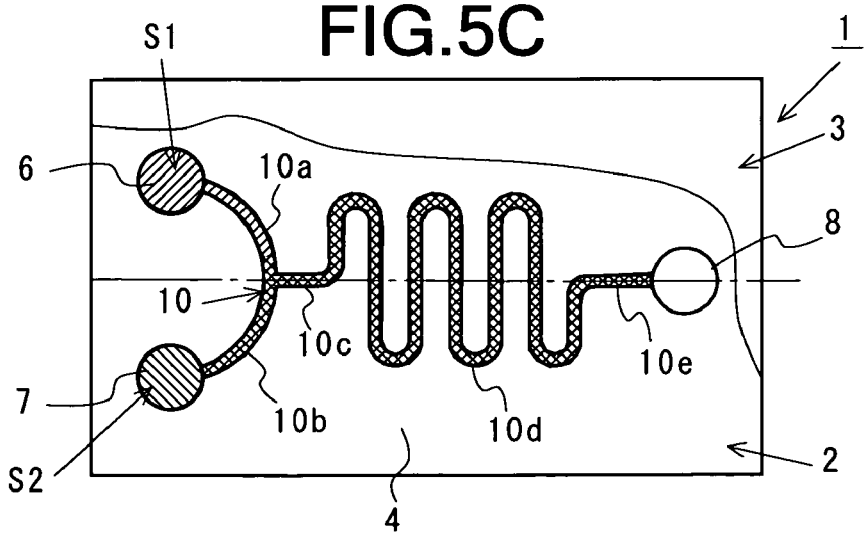
Figure 6:
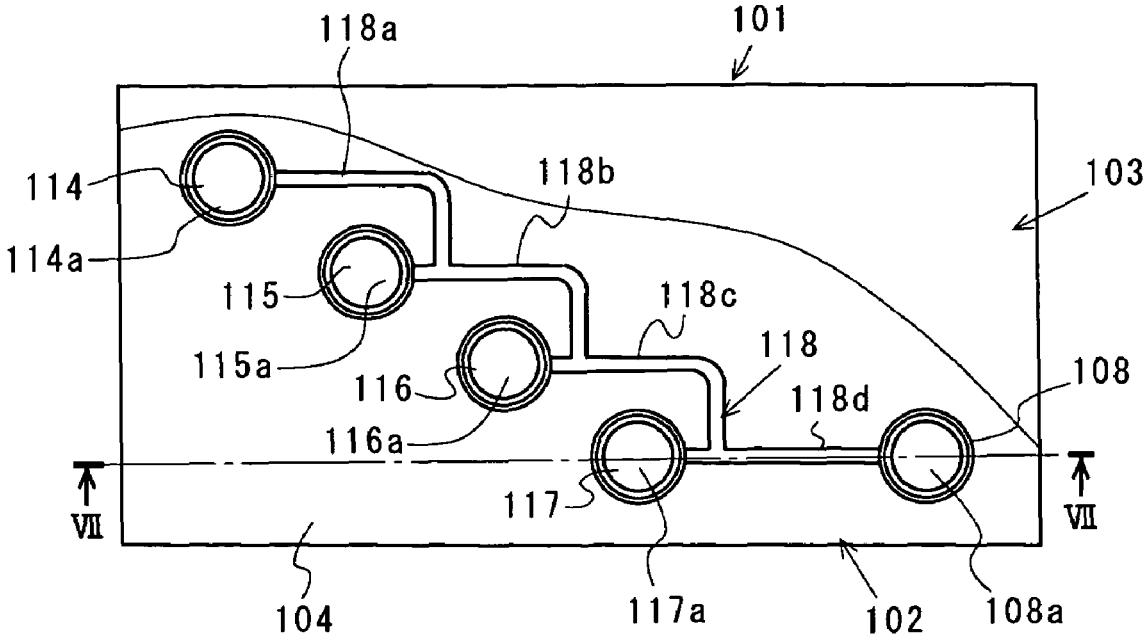
FIG. 6 is a bottom view of a part of the second preferred embodiment of a microfluid handling device according to the present invention, which is viewed along arrow Y1 of FIG. 7.
Figure 7:
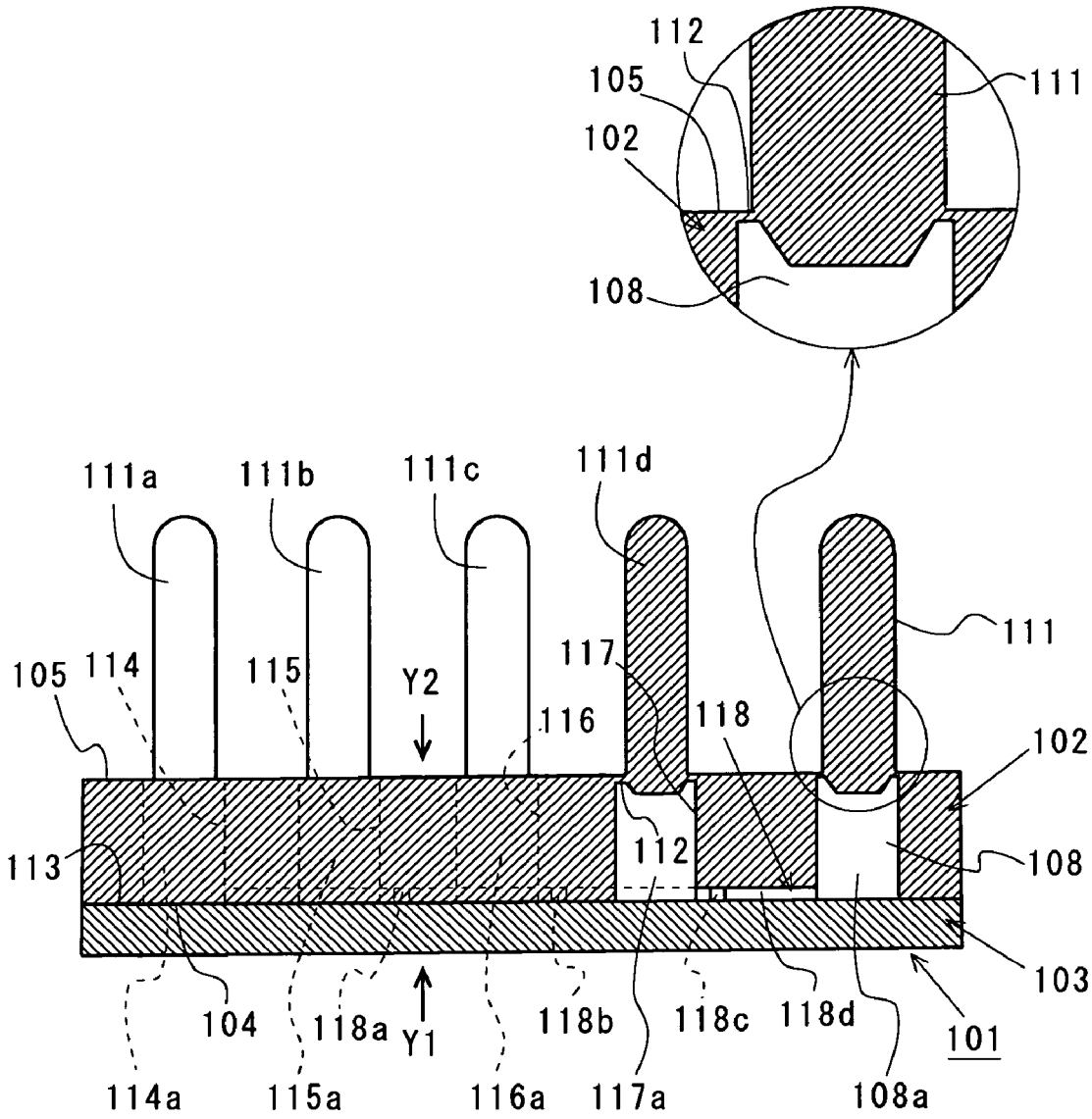
FIG. 7 is a sectional view of the second preferred embodiment of a microfluid handling device according to the present invention, which is taken along line VII-VII of FIG. 6.
Figure 8:
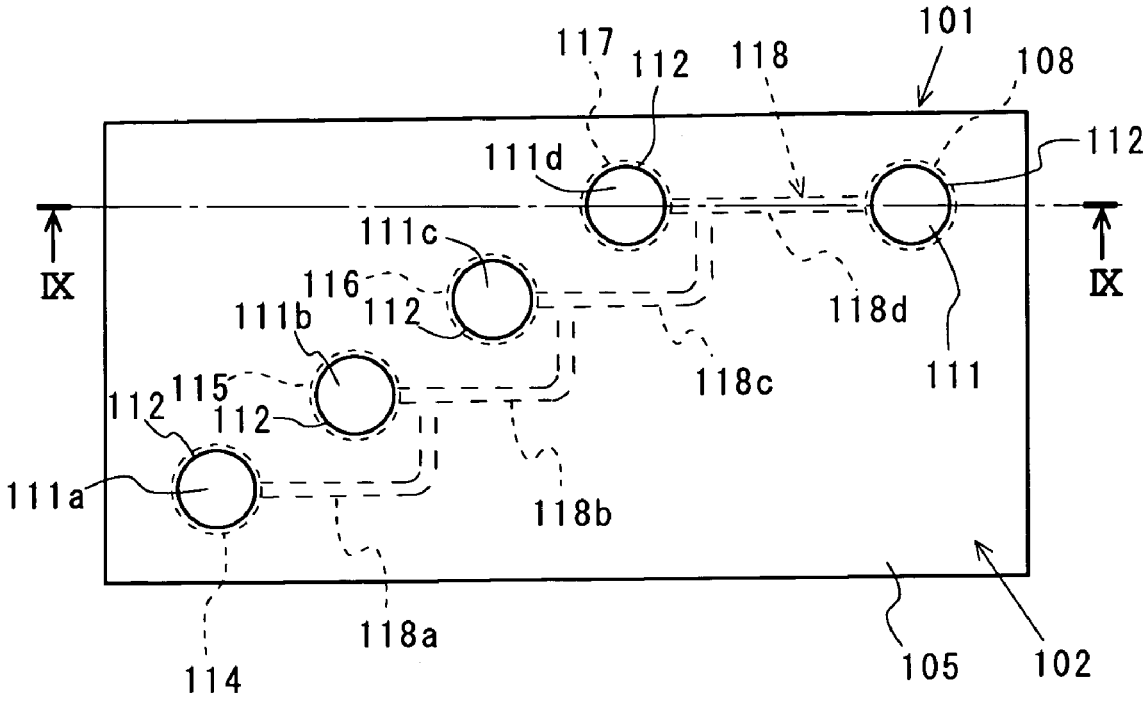
FIG. 8 is a plan view of the second preferred embodiment of a microfluid handling device according to the present invention, which is viewed along arrow Y2 of FIG. 7.
Figure 9A:
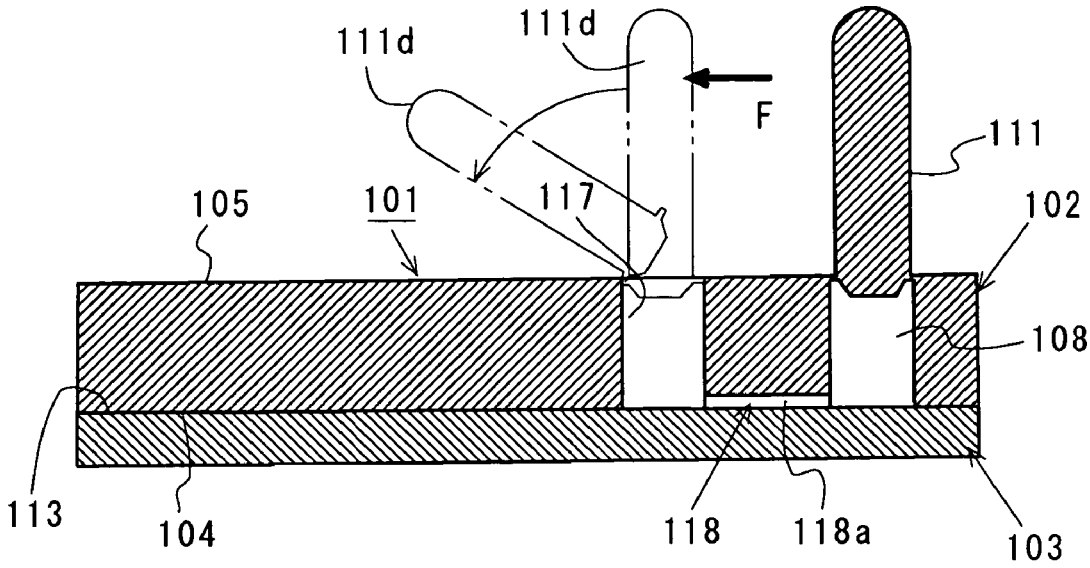
FIGS. 9A and 9B are sectional views taken along line IX-IX of FIG. 8, which show a state that the second preferred embodiment of a microfluid handling device according to the present invention is used.
Figure 9B:
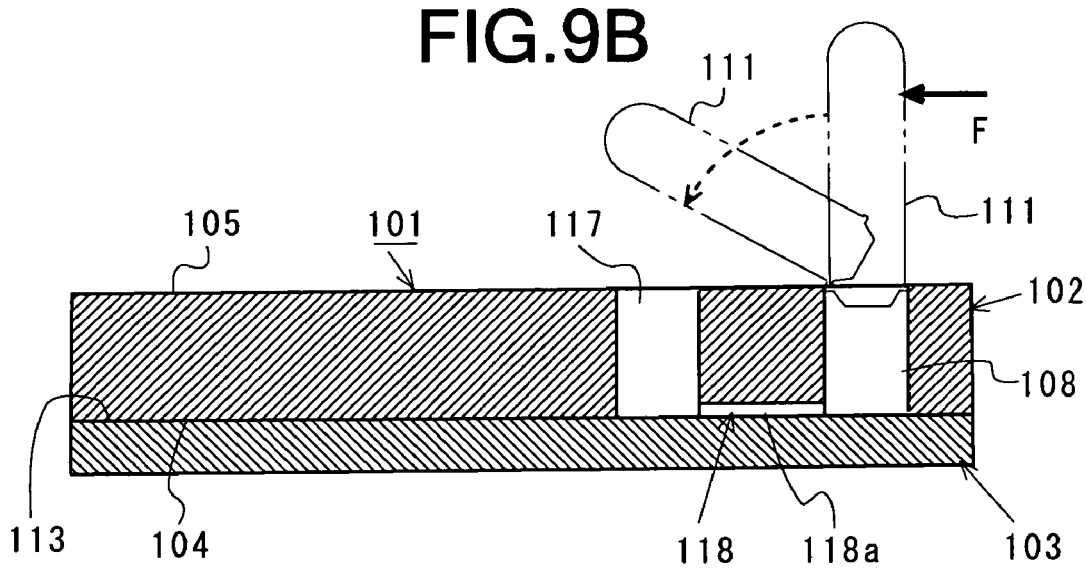

Then, if the sealing protrusion 11 is broken off (see FIG. 4B), the final storage portion 8 is communicated with the atmosphere, so that the pressure balance between the pressure due to the samples S1, S2 in the fine groove 10 and the pressure of a gas (air) in the fine groove 10 is broken. As a result, the first and second samples S1 and S2, which have flowed into the curved portions 10*a*, 10*b* and first linear portion 10*c*, run (move) through the fine groove 10 toward the final storage portion 8 due to capillarity. Then, as the first sample S1 and the second sample S2 pass through the curved portions 10*a*, 10*b*, first linear portion 10*c*, intermediate portion 10*d* and second linear portion 10*e* of the fine groove 10 in that order, they are more surely mixed with each other (at this time, a predetermined reaction proceeds if necessary), to move to the end of the second linear portion 10*e* of the fine groove 10 (see FIG. 5C). Then, in this state, for example, analysis is carried out by verifying the coloration of the mixed solution of the first and second samples S1 and S2 in the second linear portion 10*e* or by irradiating the mixed solution with measuring beams. Furthermore, the final storage portion 8 can function as a liquid housing place when the mixed solution flows out of the end of the second linear portion 10*e*. In addition, the final storage portion 8 can be utilized for mounting therein a detecting material, such as a filter paper containing a material capable of causing a specific reaction with the mixed solution, or for housing therein an inspecting solution including a reagent.

As described above, according to this preferred embodiment, since the movement of the very small amounts of samples (first sample S1 and second sample S2) in the fine flow passage can be controlled by the sealing protrusion 11 capable of being broken off, it is possible to simplify the flow control structure for a microfluid, so that it is possible to reduce the size and price of the microfluid handling device 1.

According to this preferred embodiment, the sealing protrusion 11 can be formed so as to be integrated with the bottom of the recessed portion 8*a* when the first plate member 2 is injection-molded. Therefore, it is possible to further reduce the production costs for the microfluid handling device 1 in this preferred embodiment.

According to this preferred embodiment, since it is possible to control the flow of a fluid due to the pressure difference between the inside and outside of the microfluid handling device 1 and due to capillarity, it is not required to provide any outside driving source, such as a power supply and a heat source. Therefore, the portability of the microfluid handling device 1 is very excellent, so that the microfluid handling device 1 is suitable for a POC device.

While the first and second storage portions 6 and 7 have been open to the atmosphere in this preferred embodiment, the first and second storage portions 6 and 7 may be sealed with the same sealing protrusions (not shown) as the sealing protrusion 11 for sealing the final storage portion 8, so that the sealing protrusions for the first and second storage portions 6 and 7 may be broken off when the microfluid handling device 1 is used. Thus, it is possible to prevent dust and impurities flying in the atmosphere from entering the first and second storage portions 6, 7 and fine groove 10 before a sample is injected to the storage portions 6 and 7. Moreover, if each of the storage portions 6 and 7 is provided with such a sealing protrusion, air in the groove 10 can be replaced with a gas, such as nitrogen gas, other than the atmosphere (air), so that the microfluid handling device 1 can be used in the outside environment other than the atmosphere.

While the fine groove 10 has been formed on the side of the second surface 4 of the first plate member 2 in this preferred embodiment, the fine groove 10 may be formed on the side of the first surface 13 of the second plate member 3 facing the first plate member 2.

Second Preferred Embodiment

FIGS. 6 through 10D show the second preferred embodiment of a microfluid handling device 101 according to the present invention, as a first example of a microfluid handling device used when plural kinds of samples are mixed. In this preferred embodiment, reference numbers obtained by adding 100 to the same reference numbers as those in the first preferred embodiment are given to the same or similar portions as or to those in the first preferred embodiment to omit repeated explanation.

As shown in these figures, in this preferred embodiment, the opening portions of recessed portions 114*a*, 115*a*, 116*a* and 117*a* of a first plate member 102 are closed by a second plate member 103 to form first through fourth storage portions 114 through 117. When the first through fourth storage portions 114 through 117 are closed by the second plate member 103, they are communicated with a final storage portion 108 via a fine groove 118 forming a fine flow passage (microchannel). The fine groove 118 comprises: a first fine groove 118*a* for guiding a first sample, which is injected into the first storage portion 114, toward the second storage portion 115; a second fine groove 118*b* for guiding a second sample, which is injected into the second storage portion 115, toward the third storage portion 116; a third fine groove 118*c* for guiding a third sample, which is injected into the third storage portion 116, toward the fourth storage portion 117; and a fourth fine groove for guiding a fourth sample, which is injected into the fourth storage portion 114, toward the final storage portion 118. The first fine groove 118*a* is communicated with a portion near an open end of the second fine groove 118*b* on the side of the second storage portion 115. The second fine groove 118*b* is communicated with a portion near an open end of the third fine groove 118*c* on the side of the third storage portion 116. The third fine groove 118*c* is communicated with a portion near an open end of the fourth fine groove 118*d* on the side of the fourth storage portion 117.

Similar to the above described first preferred embodiment, a sealing protrusion 111 capable of being broken off is formed so as to be integrated with the bottom of the final storage portion 108 on the side of the second surface 105 of the first plate member 102. In addition, each of sealing protrusions 111*a* through 111*d* capable of being broken off are formed so as to be integrated with the bottom of a corresponding one of the first through fourth recessed portions 114*a* through 117*a* on the side of the second surface 105. Each of the sealing protrusions 111 and 111*a* through 111*d* is designed to be detached from the first plate member 102 by breaking a disk-shaped thin connecting portion 112 off (see FIG. 9B).

Figure 10A:
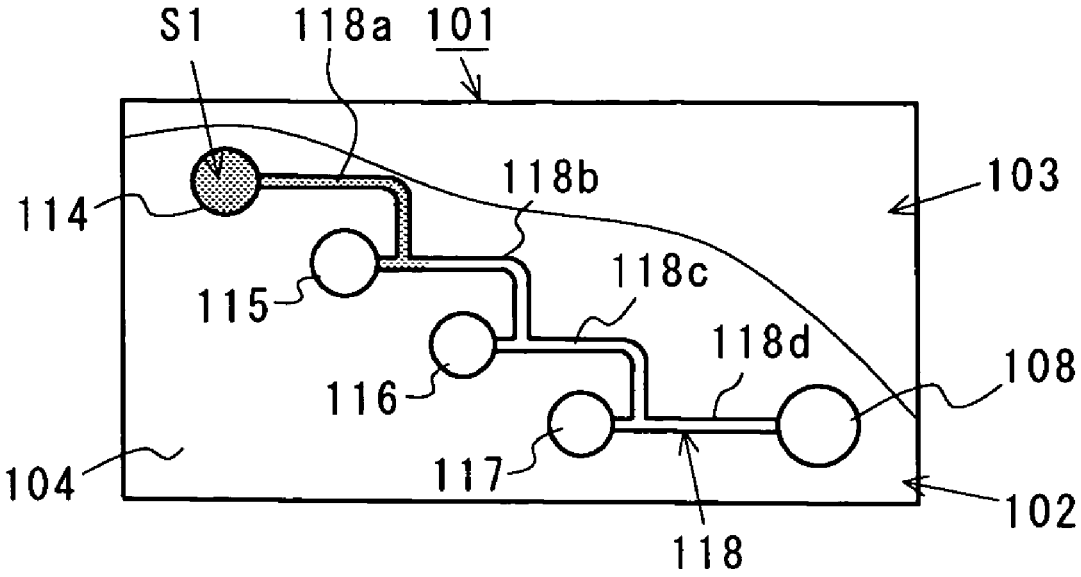
FIGS. 10A through 10D are illustrations showing a state that samples are mixed in the second preferred embodiment of a microfluid handling device according to the present invention.
Figure 10B:
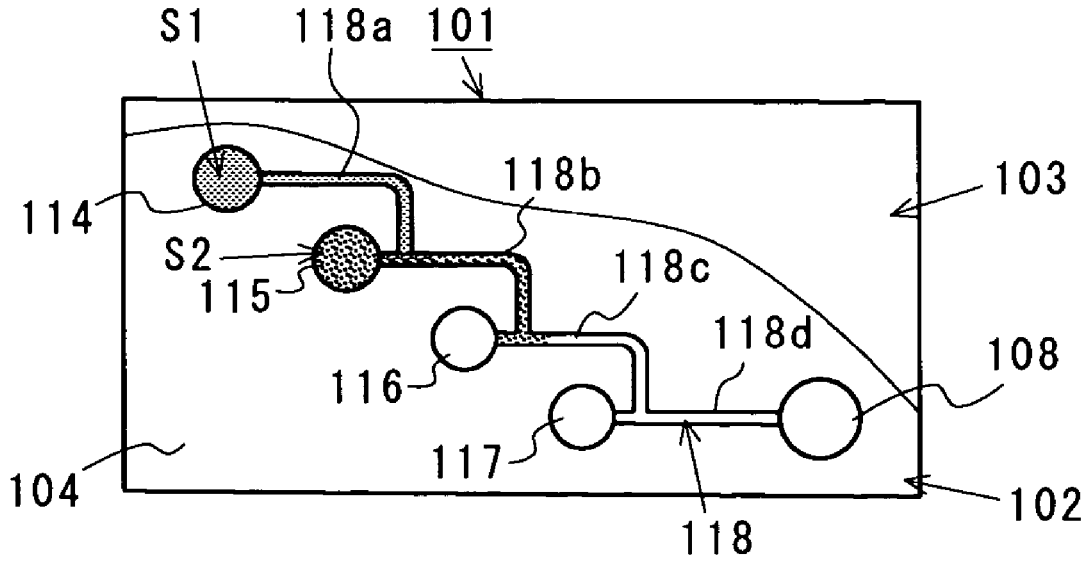
Figure 10C:
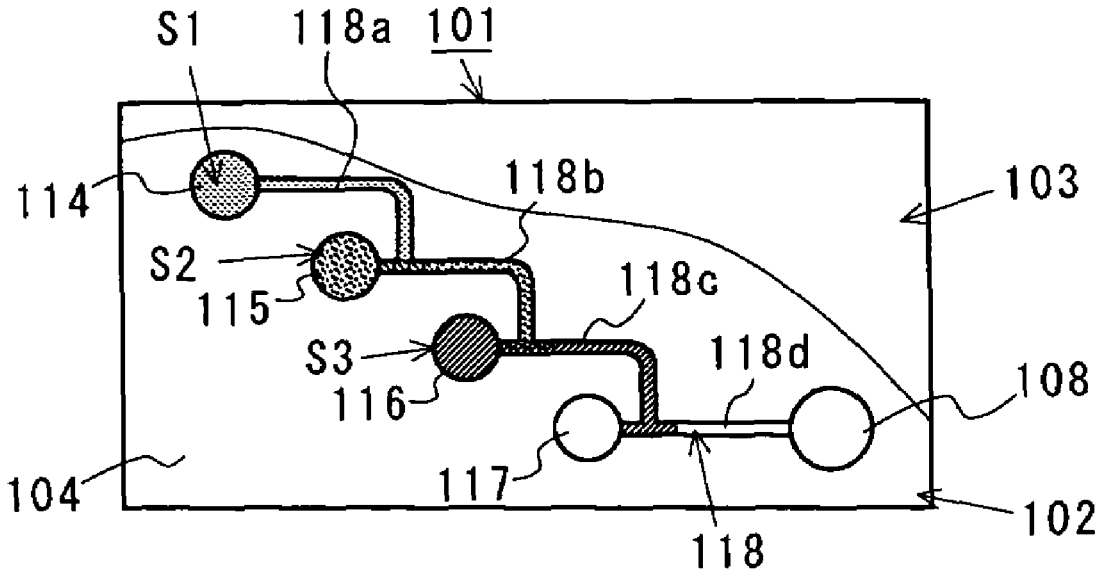
Figure 10D:
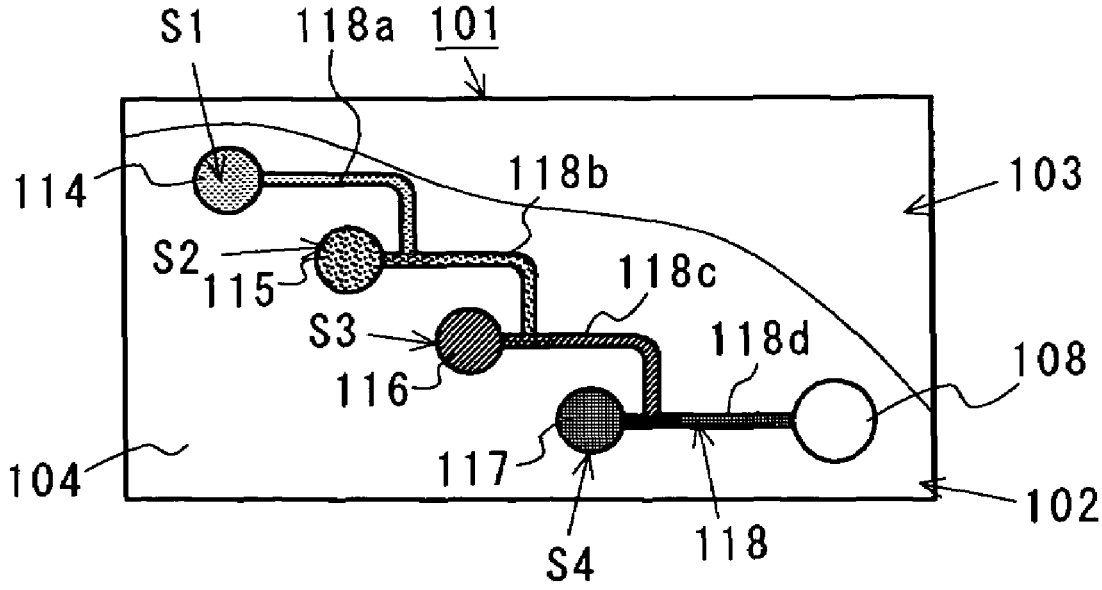
Figure 11:
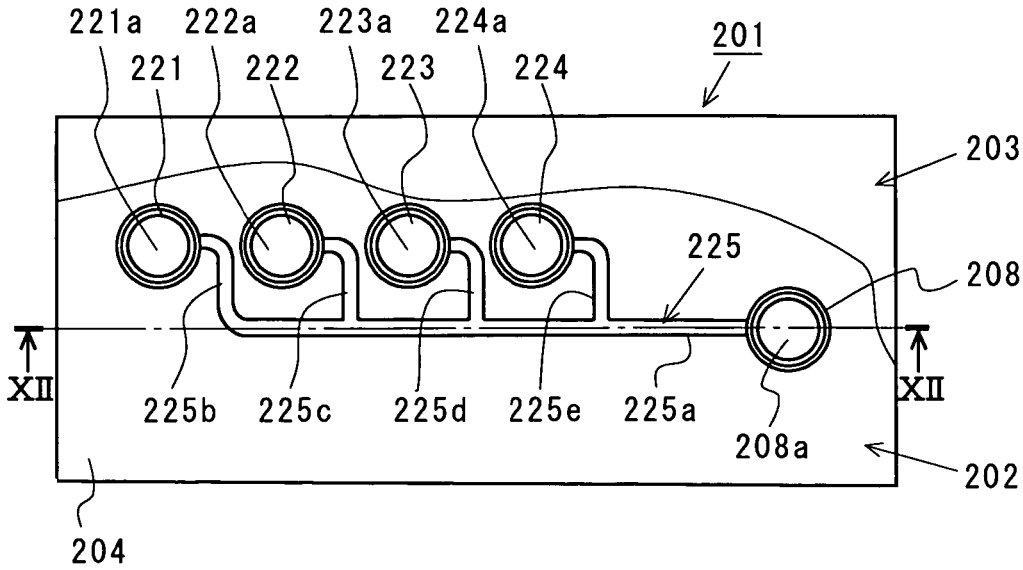
FIG. 11 is a bottom view of a part of the third preferred embodiment of a microfluid handling device according to the present invention, which is viewed along arrow Y1 of FIG. 12.
Figure 12:
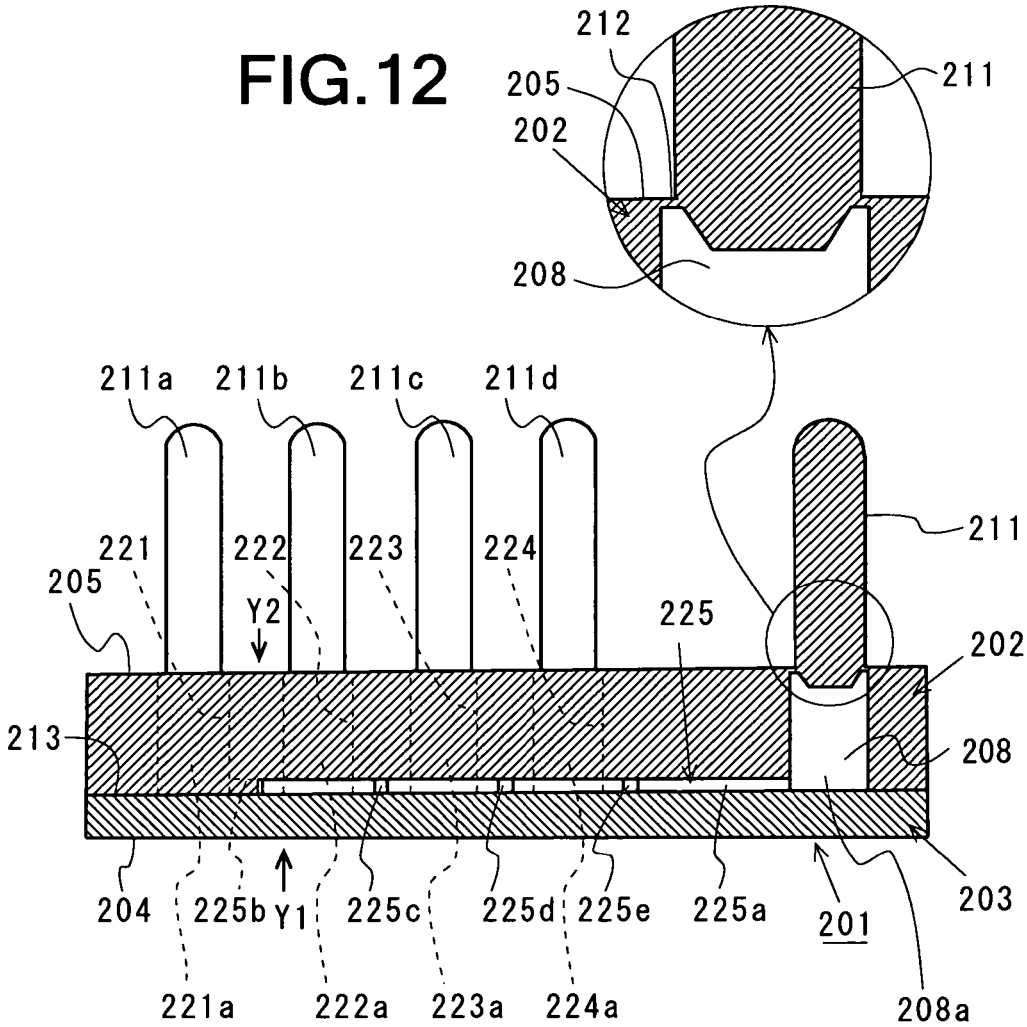
FIG. 12 is a sectional view of the third preferred embodiment of a microfluid handling device according to the present invention, which is taken along line XII-XII of FIG. 11.
Figure 13:
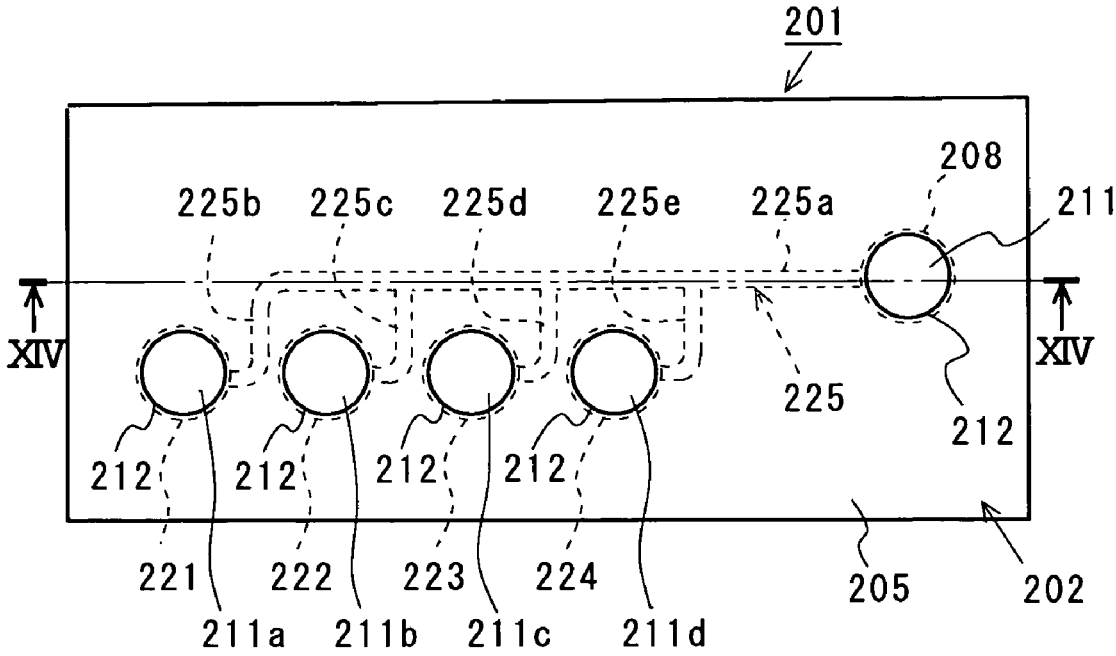
FIG. 13 is a plan view of the third preferred embodiment of a microfluid handling device according to the present invention, which is viewed along arrow Y2 of FIG. 12.
Figure 14A:
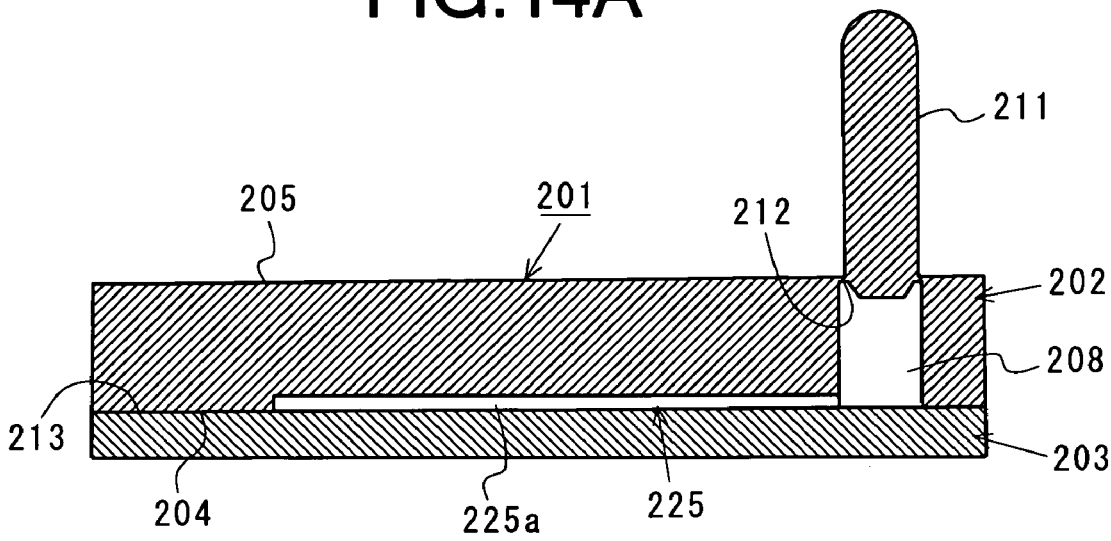
FIGS. 14A and 14B are sectional views taken along line XIV-XIV of FIG. 13, which show a state that the third preferred embodiment of a microfluid handling device according to the present invention is used.
Figure 14B:
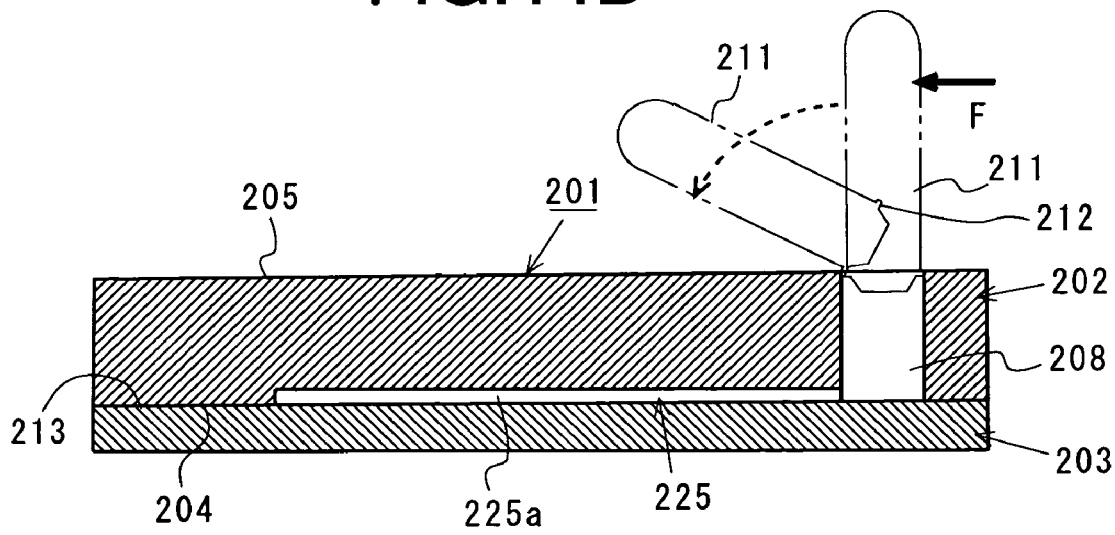

After the sealing protrusion 111*a* is broken off to inject a first sample S1 into the first storage portion 114, when the sealing protrusion 111*b* is broken off, the first sample S1 runs through the first fine groove 118*a* and second fine groove 118*b* due to capillarity, so that the front end of the first sample S1 reaches the open end portion of the second fine groove 118*b* on the side of the second storage portion 115 (see FIG. 10A).

Then, after a second sample S2 is injected into the second storage portion 115, when the sealing protrusion 111*c* is broken off, the second sample S2 is mixed with the first sample S1, or a predetermined reaction of the second sample S2 with the first sample S1 proceeds, while the second sample S2 and the first sample S1 run through the second fine groove 118*b* due to capillarity. Then, the front end of a sample (which will be hereinafter referred to as a sample A) based on the first sample S1 and second sample S2 reaches the open end portion of the third fine groove 118*c* on the side of the third storage portion 116 (see FIG. 10B). Furthermore, if it is required to extract the sample A, an extractor (not shown) may be inserted into the third storage portion 116 for extracting a required amount of sample A. That is, the third storage portion 116 may be used for extracting the sample.

Then, after a third sample S3 is injected into the third storage portion 116, when the sealing protrusion 111*d* is broken off, the third sample S3 is mixed with the sample A, or a predetermined reaction of the third sample S3 with the sample A proceeds, while the third sample S3 and the sample A run through the third fine groove 118*c* due to capillarity. Then, the front end of a sample (which will be hereinafter referred to as a sample B) based on the third sample S3 and sample A reaches the open end portion of the fourth fine groove 118*d* on the side of the fourth storage portion 117 (see FIG. 10C). Furthermore, if it is required to extract the sample B, an extractor (not shown) may be inserted into the fourth storage portion 117 for extracting a required amount of sample B. That is, the fourth storage portion 117 may be used for extracting the sample.

Then, after a fourth sample S4 is injected into the fourth storage portion 117, when the sealing protrusion 111 is broken off (see FIG. 9B), the fourth sample S4 is mixed with the sample B, or a predetermined reaction of the fourth sample S4 with the sample B proceeds, while the fourth sample S4 and the sample B run through the fourth fine groove 118*d* due to capillarity. Then, the front end of a sample (which will be hereinafter referred to as a sample C) based on the fourth sample S4 and sample B reaches the open end portion of the fourth fine groove 118*d* on the side of the final storage portion 108 (see FIG. 10D). Furthermore, the sample C is formed by the first through fourth samples S1 through S4.

Similar to the above described first preferred embodiment, analysis is herein carried out by verifying the coloration of the sample or the like. Alternatively, an extractor (not shown) may be inserted into the final storage portion 108 for extracting the sample C wherein the first through fourth samples S1 through S4 have been sufficiently mixed or reacted.

Thus, in this preferred embodiment, the movement of the very small amount of sample can be controlled if only the sealing protrusions 111*a* through 111*d*, each of which is formed so as to be integrated with the bottom of the corresponding one of the first through fourth storage portions 114 through 117, are sequentially or selectively broken off and the sealing protrusion 111, which is formed so as to be integrated with the bottom of the final storage portion 108, is broken off. Therefore, similar to the above described first preferred embodiment, it is possible to simplify the flow control structure for a microfluid (sample), so that it is possible to reduce the size and price of the microfluid handling device 101.

In this preferred embodiment similar to the above described first preferred embodiment, the sealing protrusions (sealing portions) 111 and 111*a* through 111*d* can be formed so as to be integrated with the first plate member 102 by injection molding. Therefore, it is possible to further reduce the production costs for the microfluid handling device 101.

In this preferred embodiment, since it is possible to control the flow of a fluid due to the pressure difference between the inside and outside of the microfluid handling device 101 and due to capillarity, it is not required to provide any outside driving source, such as a power supply and a heat source. Therefore, the portability of the microfluid handling device 101 is very excellent, so that the microfluid handling device 101 is suitable for a POC device.

While the first through fourth samples S1 through S4 have been mixed or reacted to obtain the sample C based on the first through fourth samples S1 through S4 in the microfluid handling device 101 in this preferred embodiment, the present invention should not be limited thereto. For example, the first and second storage portions 114 and 115, and the first and second fine grooves 118*a* and 118*b* may be omitted. Alternatively, a plurality of storage portions may be arranged between the third storage portion 116 and the fourth storage portion 117 so as to be capable of mixing five kinds or more of samples.

While the first through fourth samples S1 through S4 have been sequentially mixed or reacted in this preferred embodiment, the present invention should not be limited thereto. For example, the first sample S1, which has been previously mixed or reacted with the second sample S2, may be mixed or reacted with the third sample S3 which has been previously mixed or reacted with the fourth sample S4.

In this preferred embodiment, the first through fourth storage portions 114 through 117 may be selectively open to the atmosphere. That is, the first plate member 102 may be formed so as not to have one or more of the sealing protrusions 111*a* through 111*d*.

Third Preferred Embodiment

FIGS. 11 through 15D show the third preferred embodiment of a microfluid handling device 201 according to the present invention, as a second example of a microfluid handling device used when plural kinds of samples are mixed. In this preferred embodiment, reference numbers obtained by adding 200 to the same reference numbers as those in the first preferred embodiment are given to the same or similar portions as or to those in the first preferred embodiment to omit repeated explanation.

As shown in these figures, in this preferred embodiment, the opening portions of recessed portions 221*a*, 222*a*, 223*a* and 224*a* of a first plate member 202 are closed by a second plate member 203 to form first through fourth storage portions 221 through 224. When the first through fourth storage portions 221 through 224 are closed by the second plate member 203, they are communicated with a final storage portion 208 via a fine groove 225 forming a fine flow passage (microchannel). The fine groove 225 comprises: a main fine groove 225*a* linearly extending from the final storage portion 208; and first through fourth fine grooves 225*b* through 225*e* for communicating the first through fourth storage portions 221 through 224, which are arranged along the main fine groove 225*a*, with the main fine groove 225*a*, respectively.

Similar to the first preferred embodiment, a sealing protrusion 211 capable of being broken off is formed so as to be integrated with the bottom of the final storage portion 208 on the side of the second surface 205. In addition, each of sealing protrusions 211*a* through 211*d* capable of being broken off is formed so as to be integrated with the bottom of a corresponding one of first through fourth recessed portions 221*a* through 224*a* on the side of the second surface 205. Each of the sealing protrusions 211 and 211*a* through 211*d* is designed to be detached from the first plate member 202 by breaking a disk-shaped thin connecting portion 212 off (see FIG. 14B).

Figure 15A:
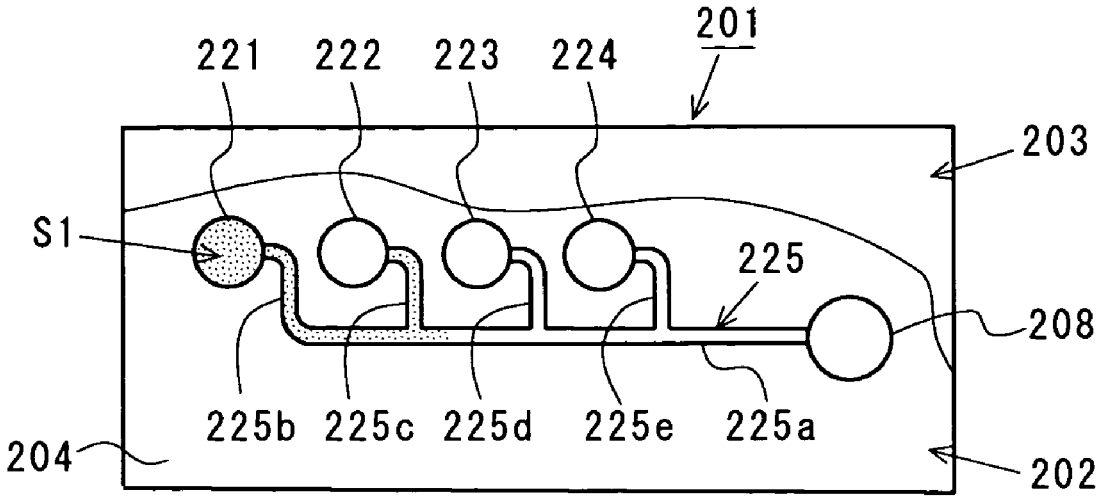
FIGS. 15A through 15D are illustrations showing a state that samples are mixed in the third preferred embodiment of a microfluid handling device according to the present invention.
Figure 15B:
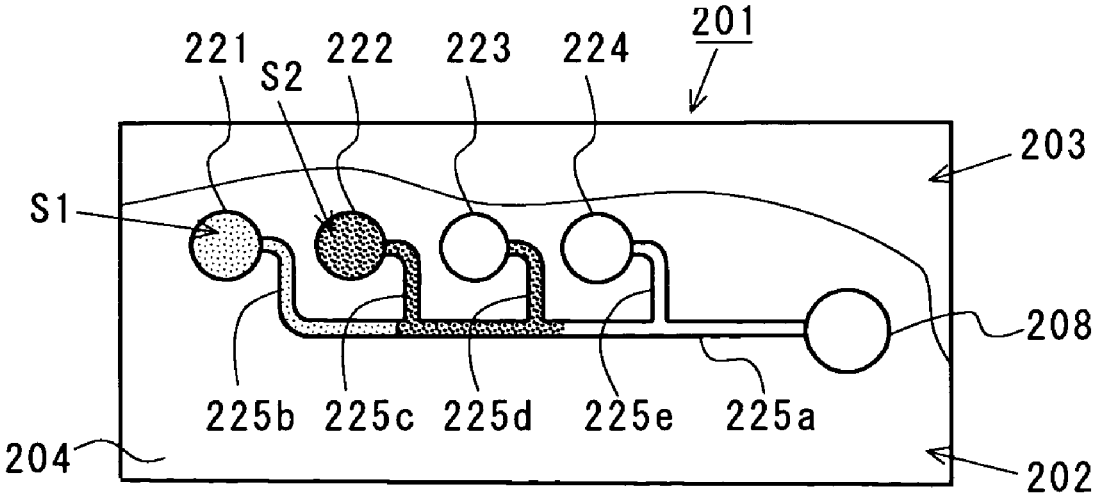
Figure 15C:
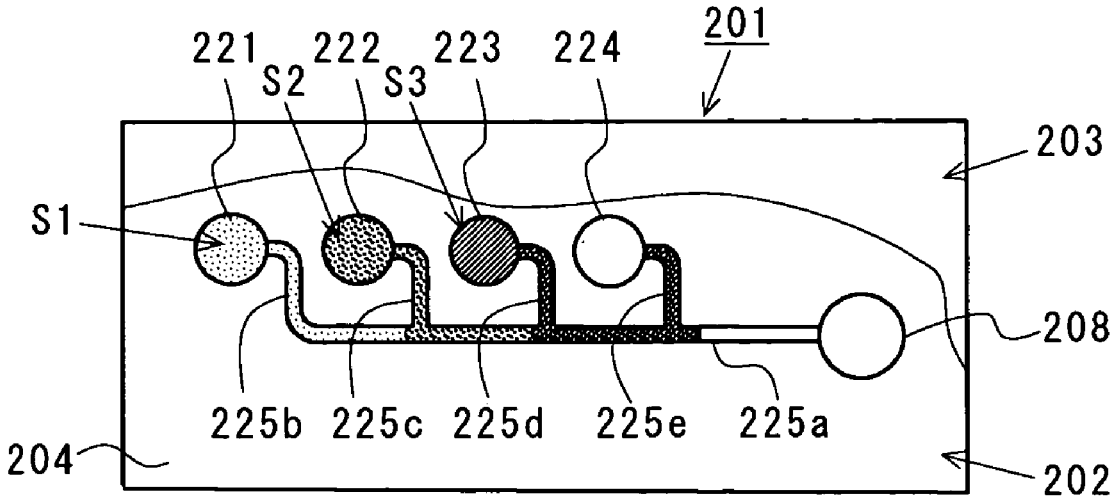
Figure 15D:
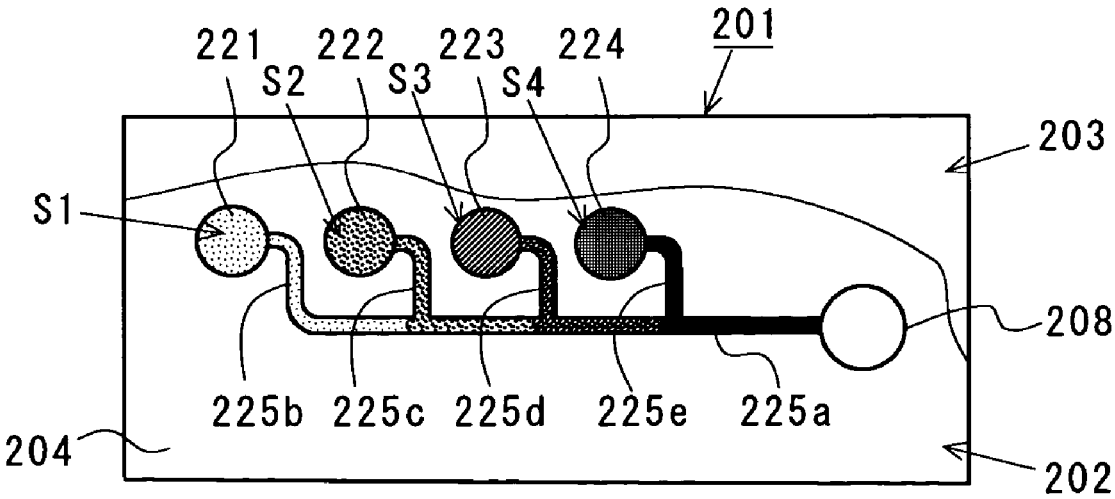

In the microfluid handling device 201 with such a construction, after the sealing protrusion 211*a* is broken off to inject a first sample S1 into the first storage portion 221, when the sealing protrusion 211*b* is broken off, the first sample S1 runs through the first fine groove 225*b* and main fine groove 225*a* due to capillarity, so that the front end of the first sample S1 reaches the open end portion of the second fine groove 225*c* on the side of the second storage portion 222 (see FIG. 15A).

Then, after a second sample S2 is injected into the second storage portion 222, when the sealing protrusion 211*c* is broken off, the second sample S2 is mixed with the first sample S1, or a predetermined reaction of the second sample S2 with the first sample S1 proceeds, while the second sample S2 and the first sample S1 run through the second fine groove 225*c* and main fine groove 225*a* due to capillarity. Then, the front end of a sample (which will be hereinafter referred to as a sample A) based on first sample S1 and the second sample S2 reaches the open end portion of the third fine groove 225*d* on the side of the third storage portion 223 (see FIG. 15B). Furthermore, if it is required to extract the sample A, an extractor (not shown) may be inserted into the third storage portion 223 for extracting a required amount of sample A. That is, the third storage portion 223 may be used for extracting the sample.

Then, after a third sample S3 is injected into the third storage portion 223, when the sealing protrusion 211*d* is broken off, the third sample S3 is mixed with the sample A, or a predetermined reaction of the third sample S3 with the sample A proceeds, while the third sample S3 and the sample A run through the third fine groove 225*d* and main fine groove 225*a* due to capillarity. Then, the front end of a sample (which will be hereinafter referred to as a sample B) based on the third sample S3 and sample A reaches the open end portion of the fourth fine groove 225*e* on the side of the fourth storage portion 224 (see FIG. 15C). Furthermore, if it is required to extract the sample B, an extractor (not shown) may be inserted into the fourth storage portion 224 for extracting a required amount of sample B. That is, the fourth storage portion 224 may be used for extracting the sample.

Then, after a fourth sample S4 is injected into the fourth storage portion 224, when the sealing protrusion 211 is broken off, the fourth sample S4 is mixed with the sample B, or a predetermined reaction of the fourth sample S4 with the sample B proceeds, while the fourth sample S4 and the sample B run through the fourth fine groove 225*e* and main fine groove 225*a* due to capillarity. Then, the front end of a sample (which will be hereinafter referred to as a sample C) based on the fourth sample S4 and sample B reaches the open end portion of the main fine groove 225*a* on the side of the final storage portion 208 (see FIG. 15D). Furthermore, the sample C is formed by the first through fourth samples S1 through S4.

Similar to the above described first preferred embodiment, analysis is herein carried out by verifying the coloration of the sample or the like. Alternatively, an extractor (not shown) may be inserted into the final storage portion 208 for extracting the sample C wherein the first through fourth samples S1 through S4 have been sufficiently mixed or reacted.

Thus, in this preferred embodiment, the movement of the very small amount of sample can be controlled if only the sealing protrusions 211*a* through 211*d*, each of which is formed so as to be integrated with the bottom of the corresponding one of the first through fourth storage portions 221 through 224, are sequentially or selectively broken off and the sealing protrusion 211, which is formed so as to be integrated with the bottom of the final storage portion 208, is broken off. Therefore, similar to the above described first and second preferred embodiments, it is possible to simplify the flow control structure for a microfluid, so that it is possible to reduce the size and price of the microfluid handling device 201.

In this preferred embodiment similar to the above described first and second preferred embodiments, each of the sealing protrusions (sealing portions) 211 and 211*a* through 211*d* can be formed so as to be integrated with the first plate member 202 by injection molding. Therefore, it is possible to further reduce the production costs for the microfluid handling device 201.

In this preferred embodiment, since it is possible to control the flow of a fluid due to the pressure difference between the inside and outside of the microfluid handling device 201 and due to capillarity, it is not required to provide any outside driving source, such as a power supply and a heat source. Therefore, the portability of the microfluid handling device 201 is very excellent, so that the microfluid handling device 201 is suitable for a POC device.

While the first through fourth samples S1 through S4 have been mixed or reacted to obtain the sample C based on the first through fourth samples S1 through S4 in the microfluid handling device 201 in this preferred embodiment, the present invention should not be limited thereto. For example, the number of storage portions and the number of fine grooves communicated with the storage portions and main fine groove 225*a* may be increased so as to be capable of increasing the number of kinds of samples to be mixed or reacted.

In this preferred embodiment, the first through fourth storage portions 221 through 224 may be selectively open to the atmosphere. That is, the first plate member 202 may be formed so as not to have one or more of the sealing protrusions 211*a* through 211*d*.

Other Preferred Embodiments

The sectional shape of each of the fine grooves 10, 118 and 225 should not be limited to the rectangular shape as described in the first through third preferred embodiments. For example, the sectional shape may be a semi-circle, a U-shape, a substantially triangle or another shape.

Figure 16:
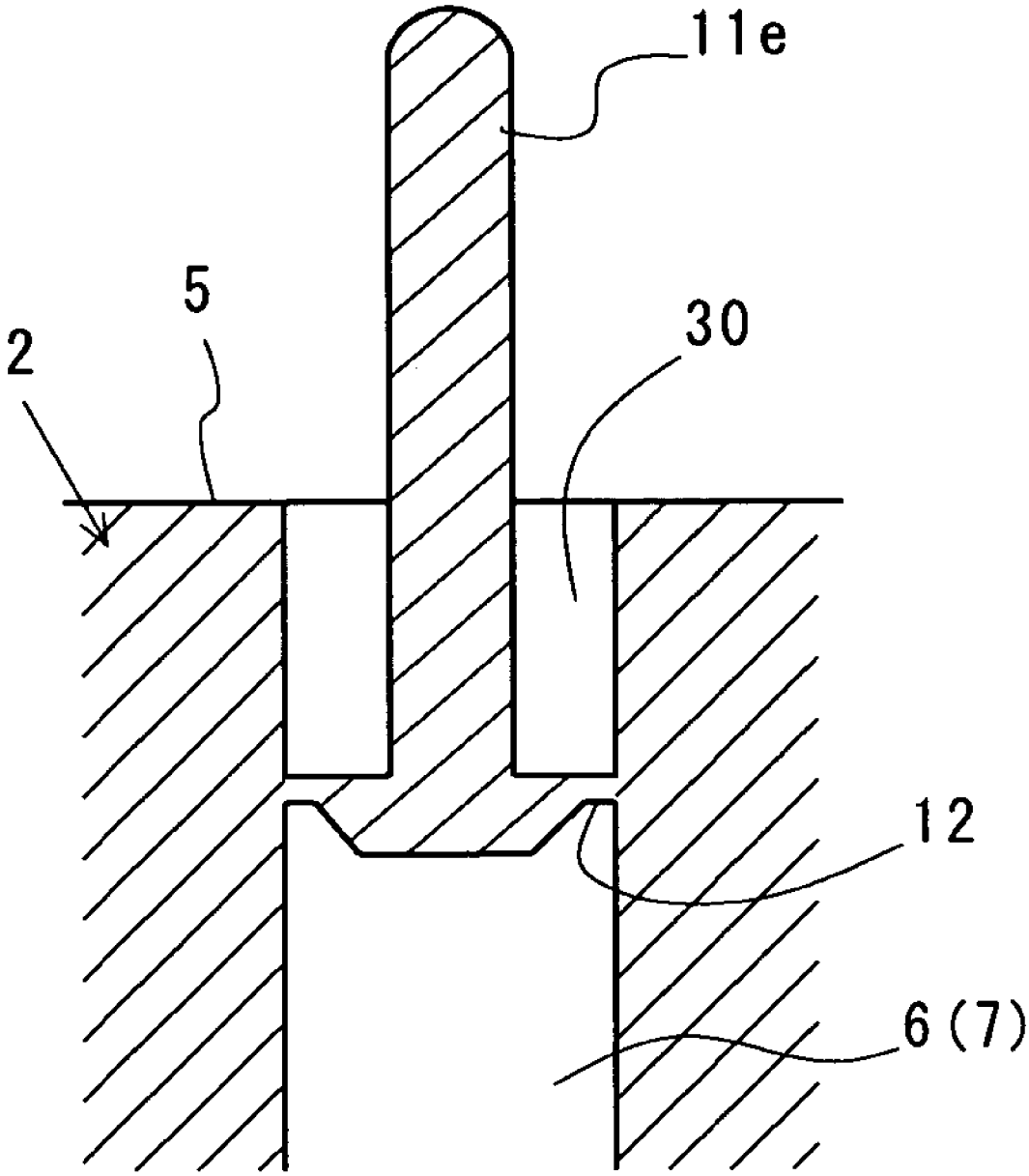
FIG. 16 is an enlarged sectional view showing a portion surrounding a sealing protrusion of a preferred embodiment of a microfluid handling device according to the present invention.

In the above described first preferred embodiment, a sealing protrusion 11*e* capable of being broken off may be formed so as to be integrated with each of the first and second storage portions 6 and 7 of the microfluid handling device 1 as shown in FIG. 16. The connecting portion 12 of the sealing protrusion 11*e* is connected to each of the first and second storage portions 6 and 7 at a position inside of the second surface 5 of the first plate member 2, so that a space above the connecting portion 12 in the figure is formed as a sample storage recessed portion 30 for storing therein a liquid sample. According to such an embodiment, if the sealing protrusions 11*e*, 11*e* of the first and second storage portions 6 and 7 are broken off, the sample storage recessed portions 30, 30 are communicated with the first and second storage portions 6 and 7, respectively, so that samples in the sample storage recessed portions 30, 30 flow into the first and second storage portions 6 and 7, respectively. Preferably, the pair of sealing protrusions 11*e*, 11*e* of the first and second storage portions 6 and 7 are substantially simultaneously broken off, if the bottom of the final storage portion 8 is not formed with the sealing protrusion 11, i.e. if the final storage portion 8 is previously open to the atmosphere. Thus, the samples S1 and S2 injected into the pair of sample storage portions 6 and 7, respectively, are more uniformly mixed. Furthermore, the sealing protrusion 11*e* with such a construction may be suitably applied to the first through fourth storage portions 114 through 117 in the second preferred embodiment and to the first through fourth storage portions 221 through 224 in the third preferred embodiment.

In each of the above described first through third preferred embodiments, the microfluid handling device 1 (101, 201) may be formed with a plurality of final storage portions 8 (108, 208) which are communicated with the fine groove 10 (118, 225). In this case, another fine groove for communicating the separately formed storage portions 8 (108, 208) with the fine groove 10 (118, 225) is designed to allow a liquid sample to run due to capillarity.

While the sealing protrusion 11 (111, 111*a* through 111*d*, 211, 211*a* through 211*d*) serving as a sealing portion has been capable of being broken off from the first plate 2 (102, 202) of the microfluid handling device 1 (101, 201) in the above described first through third preferred embodiments, the sealing portion according to the present invention should not be limited to one capable of being detached from the microfluid handling device 1 (101, 201), but the fine flow passage may be communicated with the outside environment by opening at least a part of the sealing protrusion 11 (111, 111*a* through 111*d*, 211, 211*a* through 211*d*). For example, the thickness of the flange-shaped connecting portion 12 formed around the sealing protrusion 11 (111, 111*a* through 111*d*, 211, 211*a* through 211*d*) in the above described preferred embodiment is not uniform so that a part thereof is thicker, or a connecting portion other than the flange-shaped connecting portion 12 (112, 212) is formed for connecting the first plate member 2 (102, 202) to the sealing protrusion 11 (111, 111*a* through 111*d*, 211, 211*a* through 211*d*). Thus, after the sealing protrusion 11 (111, 111*a* through 111*d*, 211, 211*a* through 211*d*) is pushed down to break at least a part of the connecting portion 12 (112, 212) to communicate the fine flow passage with the outside environment, the sealing protrusion 11 (111, 111*a* through 111*d*, 211, 211*a* through 211*d*) remains being connected to the microfluid handling device 1 (101, 201). Such a sealing portion may be used according to the present invention.

In the above described first preferred embodiment, the bottom of each of the final storage portion 8 and other storage portions may be detachably covered with an adhesive tape or pressure sensitive adhesive tape as a sealing portion in place of the sealing protrusion 11 capable of being broken off. Alternatively, the bottom of the final storage portion 8 may be detachably covered with an airtightly or fluid-tightly sealable stopper serving as a sealing portion, such as a screw material or rubber stopper. If the first and second plate members 2 and 3 of the microfluid handling device 1 are formed of, e.g., a metal, the bottom of the final storage portion 8 may be provided with a pull-top tab type stopper capable of being cut off, or a push tab type stopper capable of being open by pushing. Alternatively, a rubber stopper or resin stopper, in which a hole can be formed by a tool, such as a needle, may be used as a sealing stopper for suitably covering the bottom of each of the final storage portion and other storage portions.

The outside environment around the microfluid handling device 1 (101, 201) according to the present invention should not be limited to the atmosphere (air), but the microfluid handling device 1 (101, 201) may be suitably used in an outside environment, such as an environment replaced with nitrogen or an environment of methane or carbon monoxide, other than the atmosphere (air).

The microfluid handling device 1 (101, 201) can be suitably used as an analyzing device in the above described preferred embodiments. In addition, the microfluid handling device 1 (101, 201) can be suitably used as a device for preparing one or plural kinds of fluids to move, mix or react the fluids in a fine flow passage capable of causing capillarity, e.g., a color for reference for indicating a mixed color produced by mixing a plurality of colors, or an automatic supply device which is arranged in a planter or pot and wherein a storage portion for storing therein water or a liquid fertilizer is arranged on one side, and the root of a plant is arranged on the other side so as to be capable of automatically supplying a required amount of water or fertilizer for the plant due to capillarity.

As described above, according to the present invention, since it is possible to control the movement of the very small amount of fluid (sample) in the fine flow passage (channel) by detaching the detachable sealing portion from the end portion of the flow passage, it is possible to simplify the flow control structure for the very small amount of fluid (sample), so that it is possible to reduce the size and price of the microfluid handling device.

According to the present invention, since it is possible to control the flow of a fluid due to the pressure difference between the inside and outside of the flow passage and due to capillarity, it is not required to provide any outside driving source, such as a power supply and a heat source. Therefore, the portability of the microfluid handling device is very excellent, so that the microfluid handling device is suitable for a POC detecting device.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. A fluid handling device comprising:

a device body;

a flow passage which is formed in said device body and which has a shape for allowing a fluid to move therein due to capillarity, one end of said flow passage being open to an outside environment; and a sealing protrusion serving as a sealing portion, formed so as to be integrated with said device body, for sealing the other end of said fluid passage to isolate the other end of said flow passage from the outside environment, at least a part of said sealing protrusion being capable of being removed from the other end of said flow passage so as to allow the other end of said flow passage to be open to the outside environment for moving said fluid to the other end of said fluid passage due to capillarity, wherein said sealing protrusion is connected and integrated with said device body via a thin connecting portion capable of being removed from the other end of said flow passage, and said thin connecting portion is a flange-shaped thin connecting portion capable of being broken off.

2. A fluid handling device as set forth in claim 1, which further comprises a storage portion capable of storing therein said fluid, said storage portion being arranged at the one end of said flow passage so that the one end of said flow passage is open to the outside environment via the storage portion.

3. A fluid handling device as set forth in claim 1, which further comprises a second sealing protrusion serving as a second sealing portion, formed so as to be integrated with said device body, for sealing the one end of said flow passage to isolate the one end of said flow passage from the outside environment, at least a part of said second sealing protrusion being capable of being removed from the one end of said flow passage so as to allow the one end of said flow passage to be open to the outside environment.

4. A fluid handling device as set forth in claim 1, which further comprises:

a storage portion capable of storing therein said fluid, said storage portion being arranged at the one end of said flow passage; and a third sealing protrusion serving as a third sealing portion, formed so as to be integrated with said device body, for sealing said storage portion to isolate said storage portion from the outside environment, at least a part of said third sealing protrusion being capable of being removed from said storage portion so as to allow the one end of said flow passage to be open to the outside environment via said storage portion.

5. A fluid handling device comprising:

a device body;

at least three flow passages which are formed in said device body and which have a shape for allowing a fluid to move therein due to capillarity, one end of each of said at least three flow passages being connected to be communicated with each other, and the other end of each of said at least three flow passages being open; and a sealing protrusion serving as a sealing portion, formed so as to be integrated with said device body, for sealing the other end of at least one of said at least three flow passages to isolate the other end of the at least one of said at least three flow passages from an outside environment, at least a part of said sealing protrusion being capable of being removed from the other end of the at least one of said at least three flow passages so as to allow the other end of the at least one of said at least three flow passages to be open to the outside environment for moving said fluid to the other end of the at least one of said at least three flow passages due to capillarity, wherein said sealing protrusion is connected and integrated with said device body via a thin connecting portion capable of being removed from the other end of the at least one of said at least three flow passages, and said thin connecting portion is a flange-shaped thin connecting portion capable of being broken off.

6. A fluid handling device as set forth in claim 5, which further comprises a storage portion capable of storing therein said fluid, said storage portion being arranged at the other end of at least one of said at least three flow passages.

7. fluid handling device comprising:

a device body;

a main flow passage which is formed in said device body and which has a shape for allowing a fluid to move therein due to capillarity, one end of said main flow passage being open to an outside environment;

at least one sub-flow passage which is formed in said device body and which has a shape for allowing a fluid to move therein due to capillarity, one end of said at least one sub-flow passage being communicated with said main flow passage between the one and other ends of said main flow passage, and the other end of said at least one sub-flow passage being open to the outside environment; and a sealing protrusion serving as a sealing portion, formed so as to be integrated with said device body, for sealing the other end of said main flow passage to isolate the other end of said main flow passage from the outside environment, at least a part of said sealing protrusion being capable of being removed from the other end of said main flow passage so as to allow the other end of said main flow passage to be open to the outside environment for moving said fluid to the other end of said main flow passage due to capillarity, wherein said sealing protrusion is connected and integrated with said device body via a thin connecting portion capable of being removed from the other end of said main flow passage, and said thin connecting portion is a flange-shaped thin connecting portion capable of being broken off.

8. A fluid handling device comprising:

a device body;

a main flow passage which is formed in said device body and which has a shape for allowing a fluid to move therein due to capillarity, one end of said main flow passage being open to an outside environment;

a first sub-flow passage which is formed in said device body and which has a shape for allowing a fluid to move therein due to capillarity, one end of said first sub-flow passage being communicated with said main flow passage between the one and other ends of said main flow passage, and the other end of said first sub-flow passage being open to the outside environment;

a second sub-flow passage which is formed in said device body and which has a shape for allowing a fluid to move therein due to capillarity, one end of said second sub-flow passage being communicated with said first sub-flow passage between the one and other ends of said first sub-flow passage, and the other end of said second sub-flow passage being open to the outside environment; and a sealing protrusion serving as a sealing portion, formed so as to be integrated with said device body, for sealing the other end of said main flow passage to isolate the other end of said main flow passage from the outside environment, at least a part of said sealing protrusion being capable of being removed from the other end of said main flow passage so as to allow the other end of said main flow passage to be open to the outside environment for moving said fluid to the other end of said main flow passage due to capillarity, wherein said sealing protrusion is connected and integrated with said device body via a thin connecting portion capable of being removed from the other end of said main flow passage, and said thin connecting portion is a flange-shaped thin connecting portion capable of being broken off.

9. A fluid handling device comprising:

a device body;

a flow passage which is formed in said device body and which has a shape for allowing a fluid to move therein due to capillarity, said flow passage having a plurality of ends which are open to an outside environment; and a sealing protrusion serving as a sealing portion, formed so as to be integrated with said device body, for sealing at least one of said plurality of ends of said flow passage to isolate the at least one of said plurality of ends from the outside environment, at least a part of said sealing protrusion being capable of being removed from the at least one of said plurality of ends of said flow passage so as to allow the at least one of said plurality of ends of said flow passage to be open to the outside environment for moving said fluid to the at least one of said plurality of ends due to capillarity, wherein said sealing protrusion is connected and integrated with said device body via a thin connecting portion capable of being removed from the at least one of said plurality of ends of said flow passage, and said thin connecting portion is a flange-shaped thin connecting portion capable of being broken off.

10. A fluid handling device as set forth in claim 9, which further comprises at least one storage portion capable of storing therein said fluid, said at least one storage portion being communicated with at least one of said plurality of ends.

11. A fluid handling device comprising:

a device body;

a flow passage formed in said device body so as to have a shape for allowing a fluid to move therein due to capillarity, said flow passage having first, second and third open ends;

a first opening for injecting a first fluid into said flow passage, said first opening being formed in said device body and communicated with said first open end of said flow passage;

a second opening for injecting a second fluid into said flow passage, said second opening being formed in said device body and communicated with said second open end of said flow passage;

a third opening which is formed in said device body and which is communicated with said third open end of said flow passage; and a sealing protrusion serving as a sealing portion, formed so as to be integrated with said device body, for sealing said third opening, at least a part of said sealing protrusion being capable of being removed from said third opening, wherein said first and second fluids injected from said first and second openings are capable of moving in said flow passage due to capillarity, to be mixed or reacted with each other to form a mixed or reacted fluid, which is fed to said third open end of said flow passage due to capillarity if the at least a part of said sealing protrusion is removed from said third opening, and said sealing protrusion is connected and integrated with said device body via a thin connecting portion capable of being removed from said third opening, said thin connecting portion being a flange-shaped thin connecting portion capable of being broken off.

12. A fluid handling device as set forth in claim 11, which further comprises:

a second sealing protrusion serving as a second sealing portion for sealing said first opening, at least a part of said second sealing protrusion being capable of being removed from said first opening; and a third sealing protrusion serving as a third sealing portion for sealing said second opening, at least a part of said third sealing protrusion being capable of being removed from said second opening.

13. A fluid handling device as set forth in any one of claims 1, 5, 7, 8, 9 and 11, wherein said sealing protrusion is a rod-shaped sealing protrusion, one end of which has said flange-shaped thin connecting portion.

* * * * *